US010412990B2

(12) United States Patent
Sinclair, Jr. et al.

(10) Patent No.: US 10,412,990 B2
(45) Date of Patent: Sep. 17, 2019

(54) CONE WITH TOBACCO PLUG FILTER

(71) Applicants: Daniel S. Sinclair, Jr., Mandeville, LA (US); Charles Bachmann, Burlington, WA (US); Pedro Almonte, Santiago (DO)

(72) Inventors: Daniel S. Sinclair, Jr., Mandeville, LA (US); Charles Bachmann, Burlington, WA (US); Pedro Almonte, Santiago (DO)

(73) Assignee: Blunt Wrap U.S.A., Inc., Mandeville, LA (US)

( * ) Notice: Subject to any disclaimer, the term of this patent is extended or adjusted under 35 U.S.C. 154(b) by 902 days.

(21) Appl. No.: 14/868,113

(22) Filed: Sep. 28, 2015

(65) Prior Publication Data

US 2016/0088871 A1 Mar. 31, 2016

Related U.S. Application Data

(60) Provisional application No. 62/055,774, filed on Sep. 26, 2014.

(51) Int. Cl.
*A24C 1/26* (2006.01)
*A24D 1/02* (2006.01)
(Continued)

(52) U.S. Cl.
CPC ..... *A24C 1/26* (2013.01); *A24C 1/04* (2013.01); *A24C 3/00* (2013.01); *A24C 5/40* (2013.01); *A24D 1/02* (2013.01); *A24D 1/022* (2013.01)

(58) Field of Classification Search
None
See application file for complete search history.

(56) References Cited

U.S. PATENT DOCUMENTS 1,145,268 A 7/1915 Rossy
1,479,458 A 1/1924 De La Mota
(Continued)

FOREIGN PATENT DOCUMENTS

DE 3300302 7/1984
DE 9414404 2/1995
(Continued)

*Primary Examiner* — Michael J Felton
*Assistant Examiner* — Katherine A Will
(74) *Attorney, Agent, or Firm* — Roy Kiesel Ford Doody & North, APLC; Brett A. North

(57) ABSTRACT

A smoking article and method of manufacture provides a sheet of smokable material having a plurality of edges. One or more score or cuts are made in the sheet that each extend a partial distance from a first said edge toward a second said edge, the score or cut separating large and small sections of the sheet. A hinge is defined by a portion of the sheet of smokable material that is next to a score or cut, said hinge joining the large section to the small section. A conically shaped form is provided for shaping the sheet. The form has an outer surface, a large diameter end, a small diameter end, and a cavity that extends to said small diameter end. Corrugations on the small section of the sheet enable the small section to be fitted into the cavity via the small diameter end. The hinge enables the sheet to fold when the small section occupies the cavity in an assembled position wherein the large section is wrapped around the form outer surface. In the assembled position, the corrugations enable the small section to gather together to define a filter.

14 Claims, 47 Drawing Sheets

(51) Int. Cl.

| | |
|---|---|
| ***A24C 1/04*** | (2006.01) |
| ***A24C 3/00*** | (2006.01) |
| ***A24C 5/40*** | (2006.01) |

(56) References Cited

U.S. PATENT DOCUMENTS

| | | | |
|---|---|---|---|
| 1,631,048 | A | 5/1927 | Miller |
| 1,995,068 | A | 3/1935 | Lim |
| 4,104,431 | A | 8/1978 | Luke |
| 4,290,592 | A | 9/1981 | Kastner |
| 4,775,358 | A | 10/1988 | Jones |
| 4,832,057 | A | 5/1989 | Bale |
| 5,464,073 | A | 11/1995 | Johannes |
| 5,645,089 | A | 7/1997 | Burger et al. |
| 5,657,773 | A | 8/1997 | George |
| 5,762,074 | A | 6/1998 | Garner |
| 5,782,246 | A | 7/1998 | Axelrod |
| 5,927,488 | A | 7/1999 | Gray |
| 6,000,404 | A | 12/1999 | Case et al. |
| 6,164,443 | A | 12/2000 | Mitchell et al. |
| 6,357,448 | B1 | 3/2002 | Sinclair, Jr. |
| 6,394,320 | B1 | 5/2002 | Feiman |
| 6,526,986 | B1 | 3/2003 | Sinclair, Jr. |
| 6,571,803 | B1 | 6/2003 | Bregard |
| 6,638,613 | B1 | 10/2003 | Bland |
| 6,742,525 | B2 | 6/2004 | Sinclair, Jr. |
| 6,854,471 | B1 | 2/2005 | Sinclair, Jr. |
| D526,086 | S | 8/2006 | Mehta |
| 7,172,672 | B2 | 2/2007 | Silverbrook |
| 7,377,281 | B2 | 5/2008 | Bachmann |
| 8,800,570 | B1 | 8/2014 | Sinclair, Jr. |
| 9,179,706 | B2 | 11/2015 | Jespersen et al. |
| 2002/0083952 | A1 | 7/2002 | Braun |
| 2005/0072437 | A1 | 4/2005 | Gomez |
| 2005/0072439 | A1 | 4/2005 | Darwish |
| 2006/0000481 | A1 | 1/2006 | Sinclair, Jr. |
| 2006/0037622 | A1 | 2/2006 | Bachmann |
| 2006/0083886 | A1 | 4/2006 | Harrison et al. |
| 2010/0270303 | A1 | 10/2010 | Kesselman et al. |
| 2012/0138075 | A1* | 6/2012 | Jespersen ..... A24C 5/40 131/280 |

FOREIGN PATENT DOCUMENTS

| | | |
|---|---|---|
| DE | 19531061 | 2/1997 |
| DE | 29811803 | 10/1998 |
| DE | 202004007772 | 10/2004 |
| DK | 200600078 | 6/2006 |
| EP | 0934703 | 8/1999 |
| GB | 2336989 | 11/1999 |
| GB | 2340375 | 2/2000 |
| GB | 2383252 | 6/2003 |
| RU | 72821 | 5/2008 |
| RU | 2362464 | 7/2009 |
| WO | WO97/21362 | 6/1997 |
| WO | WO97/25886 | 7/1997 |
| WO | WO98/20757 | 5/1998 |
| WO | WO03/020057 | 3/2003 |
| WO | WO2006/016013 | 2/2006 |

* cited by examiner

CONE WITH TOBACCO PLUG FILTER

CROSS-REFERENCE TO RELATED APPLICATIONS

This application claims benefit of U.S. Patent Application Ser. No. 62/055,774, filed on 26 Sep. 2014, which application is hereby incorporated herein by reference and priority is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to smoking articles such as cigars. More particularly, the present invention relates to an improved cigar, cigar shell and method of making a cigar shell wherein a conically or frustoconically shape form defines a shape for the shell or cigar and wherein a specially configured sheet of material includes small and large sections connected by a hinge or tab and wherein the smaller section is folded or collapsed and inserted into a cavity of the form to provide a stop or filter when tobacco is added to the shell.

2. General Background of the Invention

Many cigar smokers prefer to use their own tobacco product as opposed to purchasing cigars that are already constructed and filled with tobacco. These users of fine, custom tobacco prefer to start with an empty shell which they prefer to purchase and then fill with their own custom tobacco filler material or other smokable material after the shell has been removed from its package.

Patents have issued for cigar products or smokable products that begin with an empty shell that is packaged in an empty or less than filled condition, thus enabling a smoker to later add his or her custom tobacco filler. For example, the Sinclair U.S. Pat. Nos. 6,321,755; 6,357,448; 6,526,986; and 7,717,119, each hereby incorporated herein by reference disclose tobacco shells that are packaged empty of contents so that a user can add his or her custom tobacco or other fill material to the shell after opening the package.

BRIEF SUMMARY OF THE INVENTION

The present invention provides an improved smoking article and a method of making the improved smoking article. The article includes a sheet of smokable material having a plurality of edges. One or more score or cuts are provided in the sheet that each extend a partial distance from a first edge toward a second edge, the score or cut separating large and small sections of the sheet. A hinge is defined by a portion of the sheet of smokable material that is next to a score or cut or in between two of such scores or cuts. The hinge joins the large section to the small section.

A conically shaped form has an outer surface, a large diameter end, a small diameter end, and a cavity that extends to said small diameter end.

Corrugations on the small section of the sheet enable the small section of the sheet of material to be fitted into the cavity of the form via the small diameter end.

The hinge enables the sheet to fold when the small section occupies the cavity in an assembled position and wherein the large section is wrapped around the form outer surface; and In the assembled position, the corrugations enable the small section to gather together to define a filter.

In one embodiment, there are two scores or cuts and said hinge is in between the two scores or cuts.

In one embodiment, there is one score or cut and said hinge is in between the score or cut and a said edge.

In one embodiment, the large section is rectangular.

In one embodiment, the small section is rectangular.

In one embodiment, the form and sheet are packaged in the assembled position in a package.

In one embodiment, the package is a bag.

In one embodiment, the package is a tube.

In one embodiment, the form and sheet are separable after they are in the assembled position.

In one embodiment, the sheet is held in a conical shape with a fastener in said assembled position.

In one embodiment, the fastener includes an adhesive.

In one embodiment, the form cavity is an open ended bore.

In one embodiment, a rod is contained within the bore.

In one embodiment, the hinge is spaced equally between two of said edges.

In one embodiment, the hinge is spaced closed to a first edge and farther from a second edge.

In one embodiment, two of said edges define an acute angle.

In one embodiment, an edge at said small diameter section has first and second positions that define an obtuse angle.

In one embodiment, the filter includes some added tobacco material.

The present invention provides a method of constructing a smokable article. The method includes providing a form having a frustoconical shape, a first smaller diameter end having an opening, a larger diameter end, and a cavity that extends to said smaller diameter opening.

A sheet of smokable material having a plurality of edges is provided.

The method includes forming a cut or score on the sheet of material that extends only a partial distance from one edge toward a second edge.

The hinge is located at the second edge, positioned in between said cut or score and said second edge;

The score or cut and hinge are placed in between a large section and a small section of said sheet.

The small section is collapsed. The small section is then fitted into the cavity via the small diameter opening.

The large section is wrapped about the form outer surface.

The hinge bends at the smaller diameter end of the form. The combination of sheet of material and form (or the sheet of material alone is then packaged).

In one embodiment, both the sheet of smokable material and the form are packaged.

In one embodiment, the form and sheet of material are nested, wherein the sheet large section is wrapped around the form.

In one embodiment, a connecting material holds the sheet in a wrapped, generally frustoconically shaped position.

In one embodiment, there is an additional step of separating the form and the sheet.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
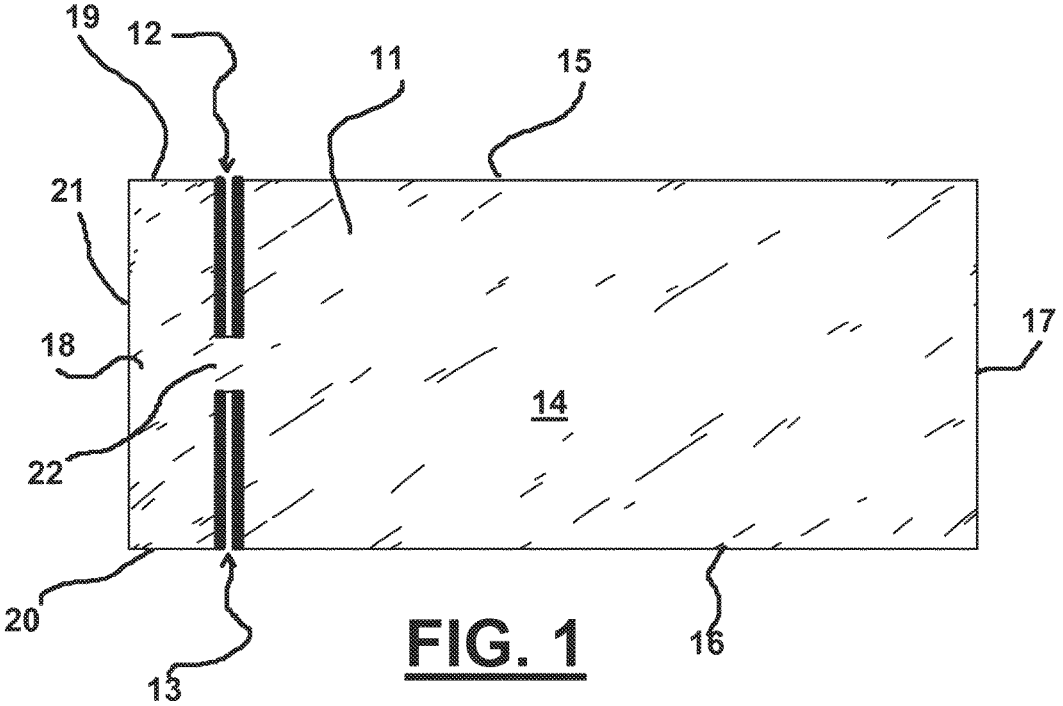
FIG. 1 is a partial plan view of the preferred embodiment of the present invention and illustrating the method of the present invention.
Figure 2:
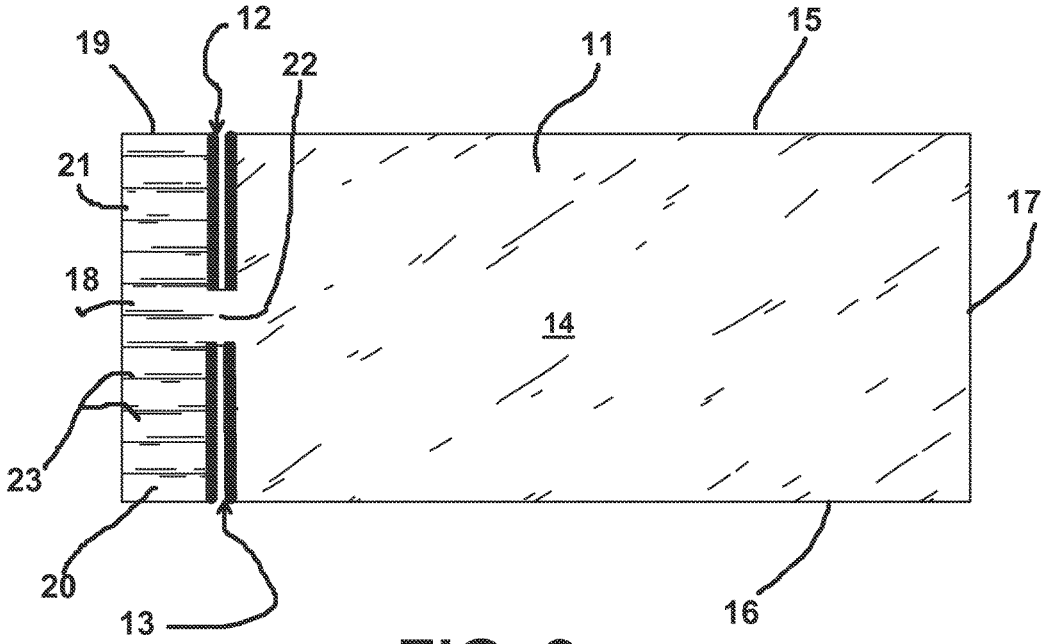
FIG. 2 is a partial plan of the preferred embodiment of the apparatus of the present invention and illustrating the method of the present invention.

FIGS. 1-13 show the first embodiment of the apparatus of the present invention designated generally by the numeral 10. Smoking article 10 utilizes a specially configured sheet of material 11 that can be seen in FIGS. 1 and 2. In FIG. 1, the sheet of material 11 has a pair of opposed cuts, slots or scores 12, 13. In between the cuts 12 and 13 can be seen a hinge or tab or bridge section 22. The cuts 12, 13 and hinge 22 divide the sheet of material 11 into a larger section 14 and smaller section 18.

The larger section 14 has side edges 15 and 16 and an end edge 17. The smaller section 18 has side edges 19, 20 and an end edge 21.

Figure 3:
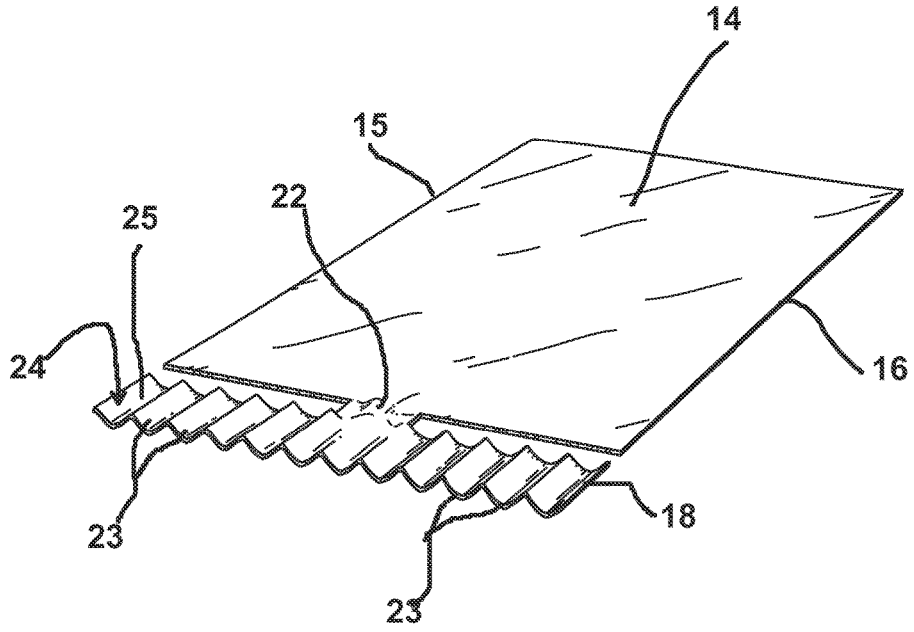
FIG. 3 is a partial perspective view of the preferred embodiment of the apparatus of the present invention and illustrating the method of the present invention.
Figure 4:
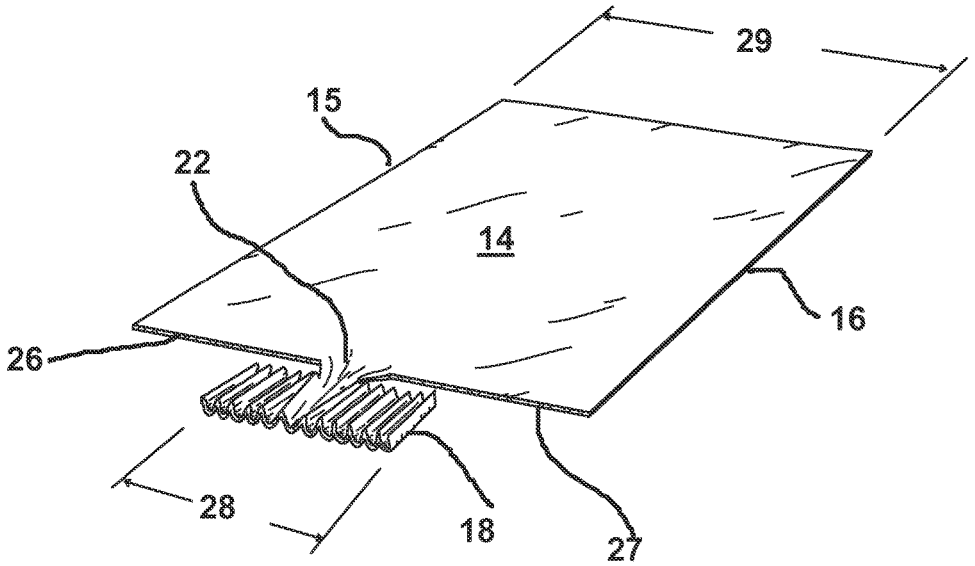
FIG. 4 is a partial perspective view of preferred embodiment of the apparatus of the present invention and illustrating the method of the present invention.

As part of the method of the present invention and in order to form the apparatus 10 of the present invention, corrugations or folds 23 are formed on smaller section 18 in between side edges 19 and 20. These corrugations or folds can be seen in FIGS. 2-5. Each corrugation or fold can be characterized by troughs or grooves 24 and peaks or ridges 25 as seen in FIG. 3. In FIG. 4, the corrugations or folds enable the smaller section 18 to be collapsed so that the collapsed width 28 is smaller than the overall width 29 of the sheet of material 11.

Figure 5:
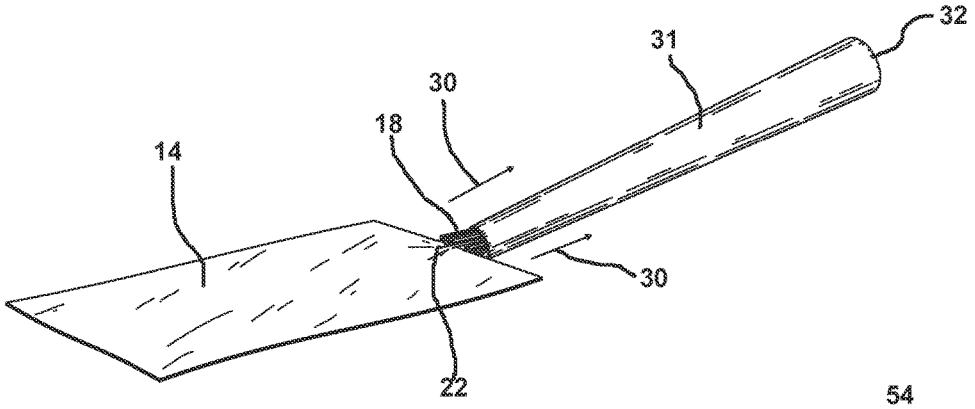
FIG. 5 is a partial perspective view of the preferred embodiment of the apparatus of the present invention and illustrating the method of the present invention.
Figure 6:
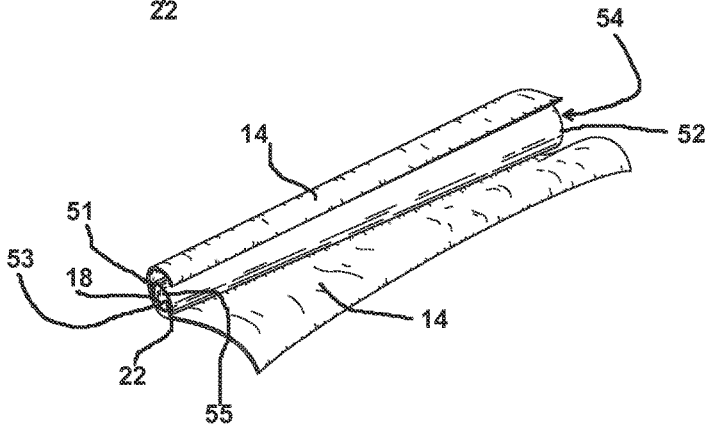
FIG. 6 is a partial perspective view of the preferred embodiment of the apparatus of the present invention and illustrating the method of the present invention.

In FIG. 4, the edges 26, 27 are those edges of larger sheet 14 that are next to the slots or cuts at 12, 13. Each of the edges 26, 27 communicates with the hinge or bridge section or tab 22 as seen in FIGS. 3 and 4. In FIG. 5, the smaller section 18 has been fully collapsed and gathered into a cylindrical shape so that the smaller section 18 fits into the bore 32 of frustoconical form or mandrel 31. Mandrel or form 31 can have an open ended bore 32 that communicates with end openings 53, 54. Form or mandrel 31 has a smaller diameter opening 53 at end 51. Form or mandrel 31 has a larger diameter opening 54 at end 54. Smaller diameter end 51 has a circular rim 55. As will be described more fully hereinafter, sheet 11 has hinge 22 that folds over rim 55 after smaller section 18 is inserted into bore 132 at smaller end opening 53. In FIG. 5, arrows 30 schematically illustrate the insertion of the collapsed or gathered smaller section 18 of sheet 11 into the bore 32 of mandrel or form 31.

Figure 7:
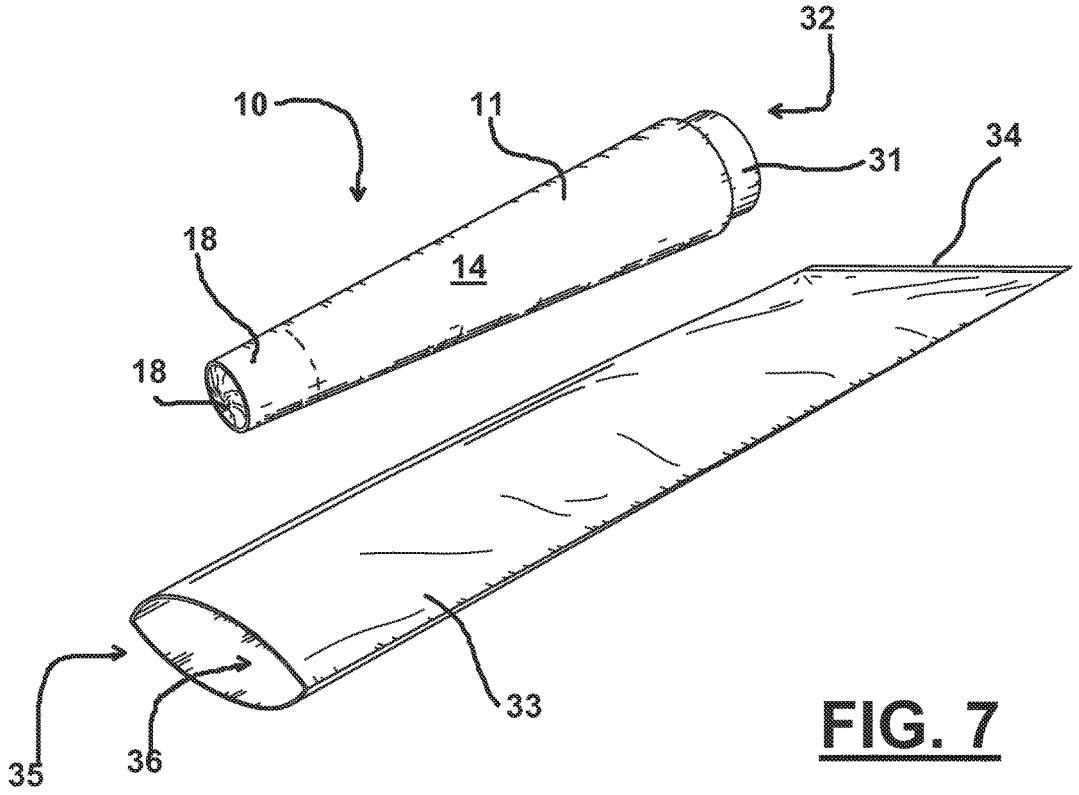
FIG. 7 is a partial perspective view of the preferred embodiment of the apparatus of the present invention and illustrating the method of the present invention.

After the collapsed smaller section 18 is inserted into bore 32, hinge or bridge section or tab 22 enables larger section 14 of sheet of material 11 to be folded so that it can be wrapped around the frustoconically shaped outer surface of form 31. The hinge 22 thus bends around the smaller diameter end 51 of form 31. This folding of the larger section 14 of sheet 11 about mandrel 31 can be seen in FIG. 6. In FIG. 7, sheet of material 11 is shown fully wrapped around mandrel 31 wherein smaller section 18 has been stored in bore 32 of mandrel 31 and larger section 14 has been wrapped around the frustoconically shaped outer surface of mandrel 31.

Figure 8:
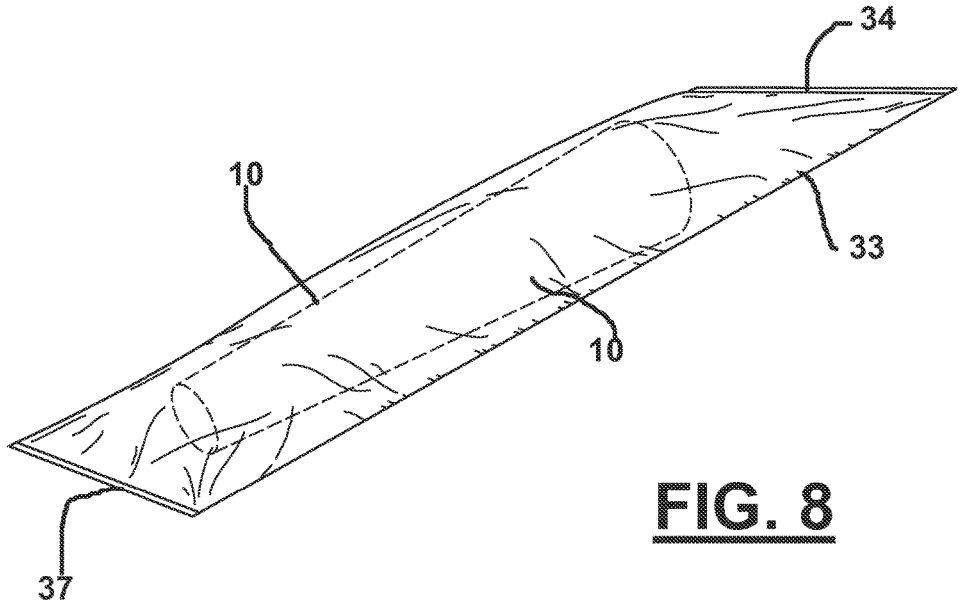
FIG. 8 is a partial perspective view of the preferred embodiment of the apparatus of the present invention and illustrating the method of the present invention.

The combination of mandrel 31 and sheet of material 11 can be packaged by insertion into interior 36 of package or wrapper 33. The package or wrapper 33 has a closed end portion 34 and an open end portion 35. The mandrel 31 and sheet of material 11 is shown in FIG. 7 in the wrapped configuration within the inserted open end 35 into interior 36. A seal 37 would then be formed at open end 35 as shown in FIG. 8.

Figure 9:
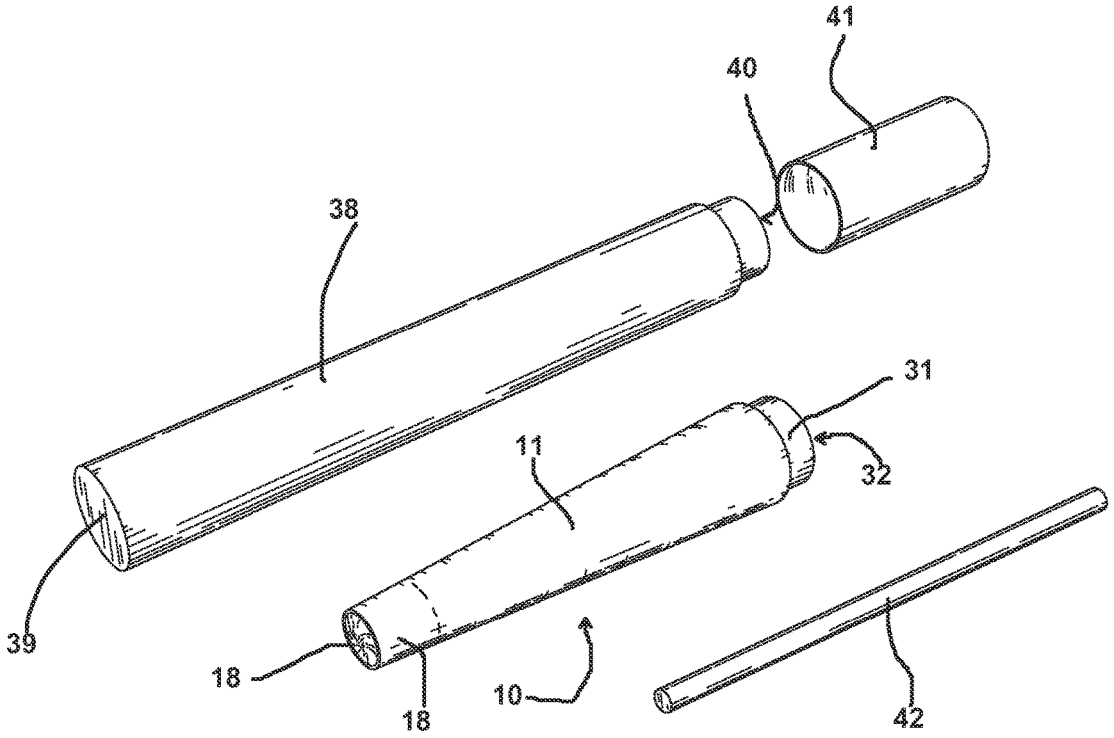
FIG. 9 is an exploded perspective view of the preferred embodiment of the apparatus of the present invention and illustrating the method of the present invention.

The package or wrapper 33 can be of flexible plastic material. FIG. 9 illustrates that a tubular package 38 could be employed to house the combination of mandrel 31 and sheet of material 11 as shown. In FIG. 9, a rod 42 could be housed within bore 32 of mandrel 31. The combination of mandrel 31, sheet of material 11, and rod 42 could then be housed in tubular package 38. Tubular package 38 provides closed end 39 and open end 40. Closure cap 41 enables a closure of the tubular package 38.

Figure 10:
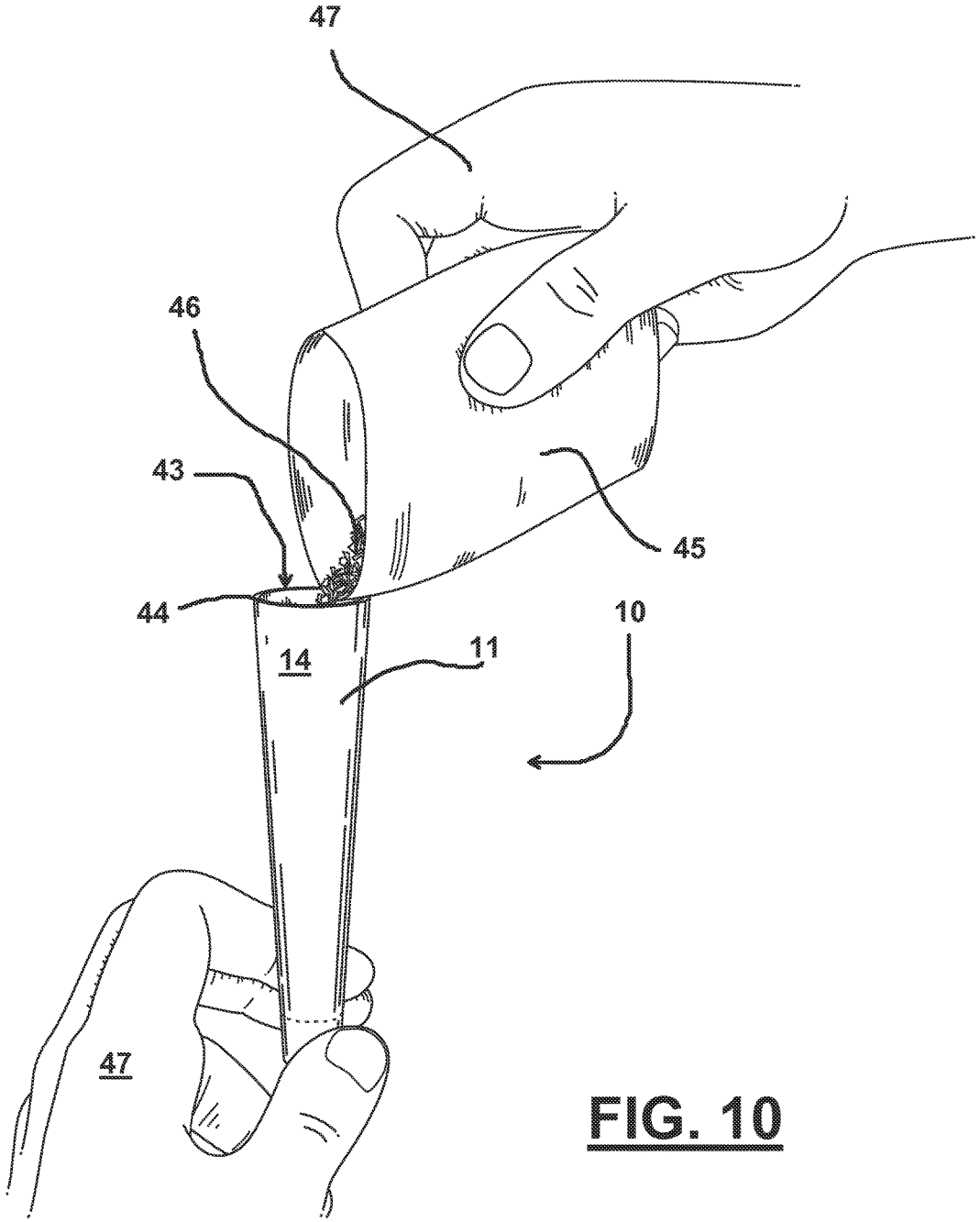
FIG. 10 is a perspective view of the preferred embodiment of the apparatus of the present invention and illustrating the method of the present invention.

In FIG. 10, the apparatus 10 of the present invention enables a user or smoker 47 to insert his or her custom tobacco material or other smokable material 46 into hollow interior 36 of sheet 11 larger section 14 after the sheet of material 11 has been removed from its package or wrapper 33, 38 and then separated from mandrel 31. The larger section 14 has a frustoconical shape with an opening at 44 in FIG. 10 into which custom tobacco material or other smokable material 46 can be added, such as dispensed from package 45 as shown.

Figure 11:
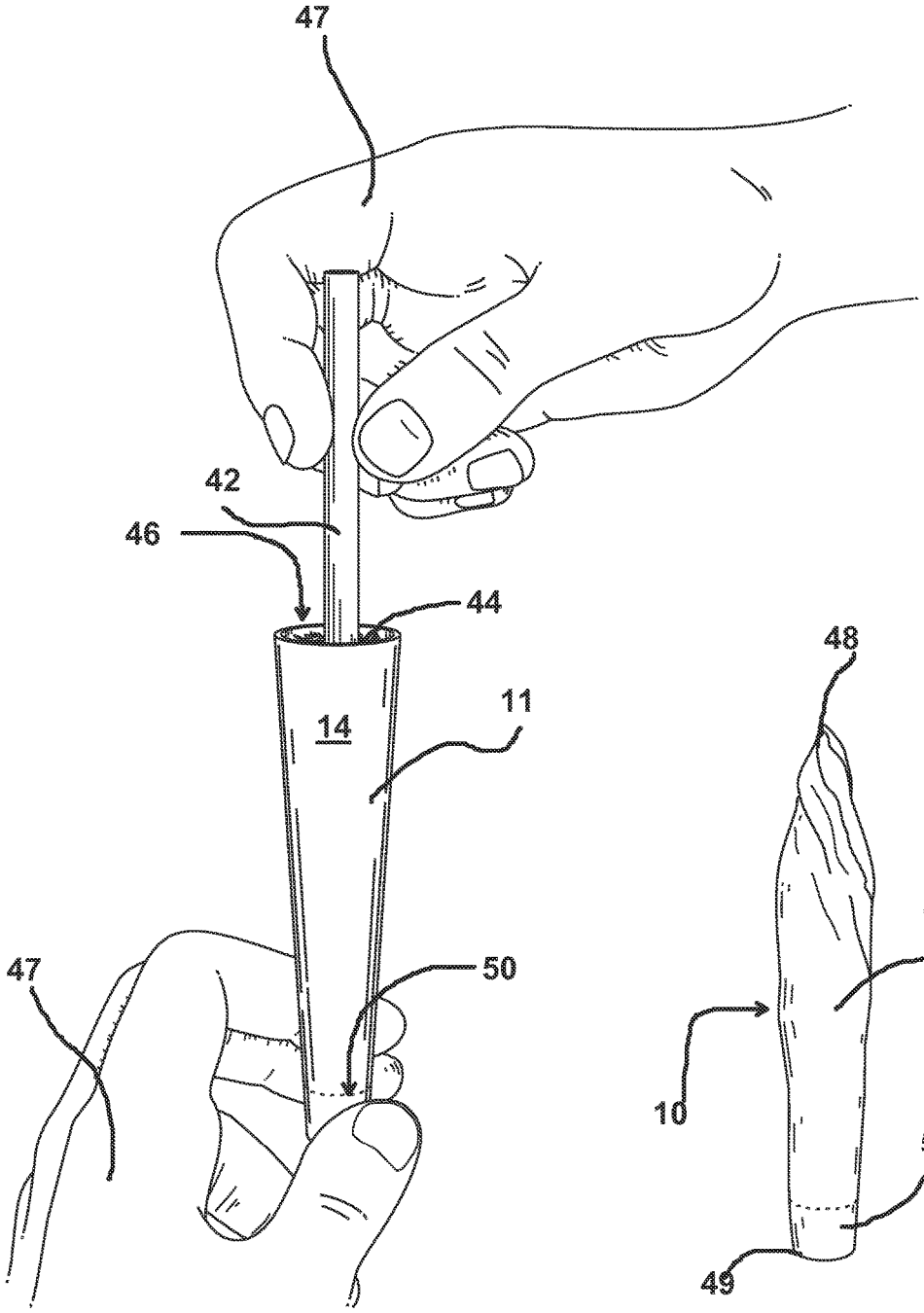
FIG. 11 is a perspective view of the preferred embodiment of the apparatus of the present invention and illustrating the method of the present invention.
Figure 12:
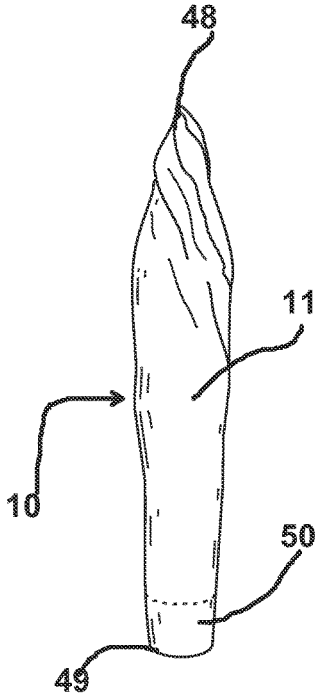
FIG. 12 is a perspective view of the preferred embodiment of the apparatus of the present invention and illustrating the method of the present invention.

In FIG. 11, a user 47 can use rod 42 to tamp or compress the smokable material 46 within larger section 14 of sheet 11. In such a situation, the smaller section 18 forms a filter at 50 so that the tobacco or other fill material 46 does not exit the interior 43 of sheet 11 in FIG. 11. In FIG. 12, the open end 44 of sheet of material 11 is wrapped or twisted until it is closed to form a closure at 48.

Figure 13:
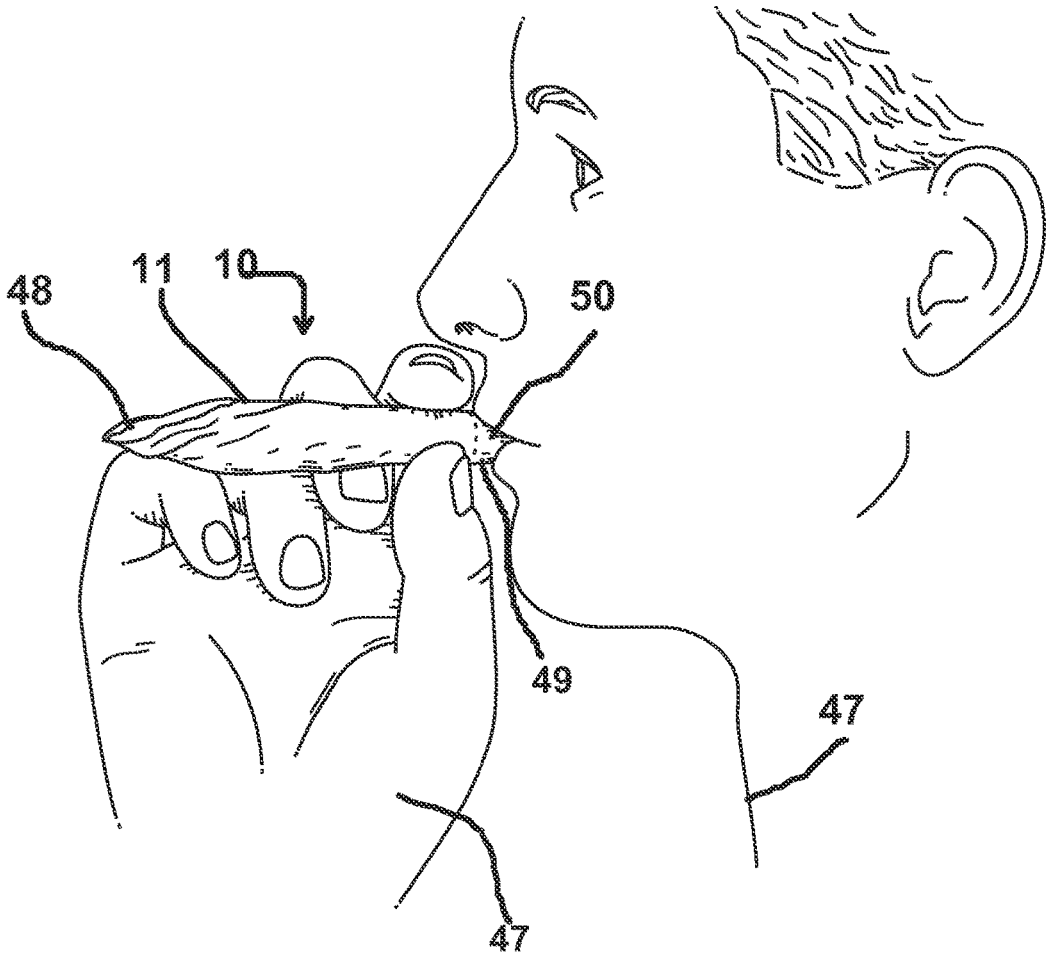
FIG. 13 is a perspective view of the preferred embodiment of the apparatus of the present invention and illustrating the method of the present invention.
Figure 14:
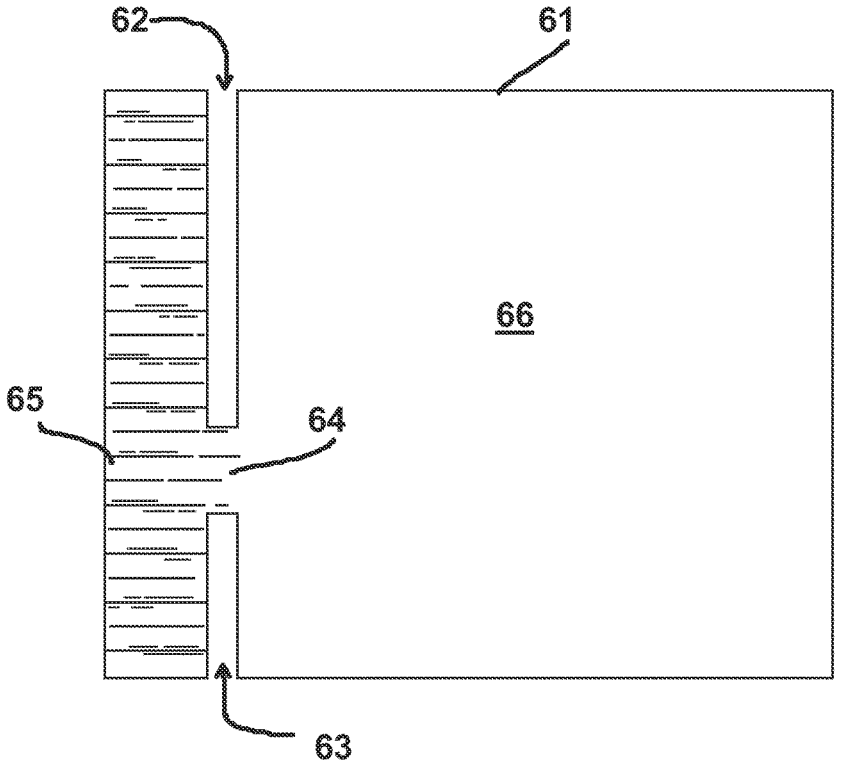
FIG. 14 is a plan view of a second embodiment of the apparatus of the present invention.
Figure 15:
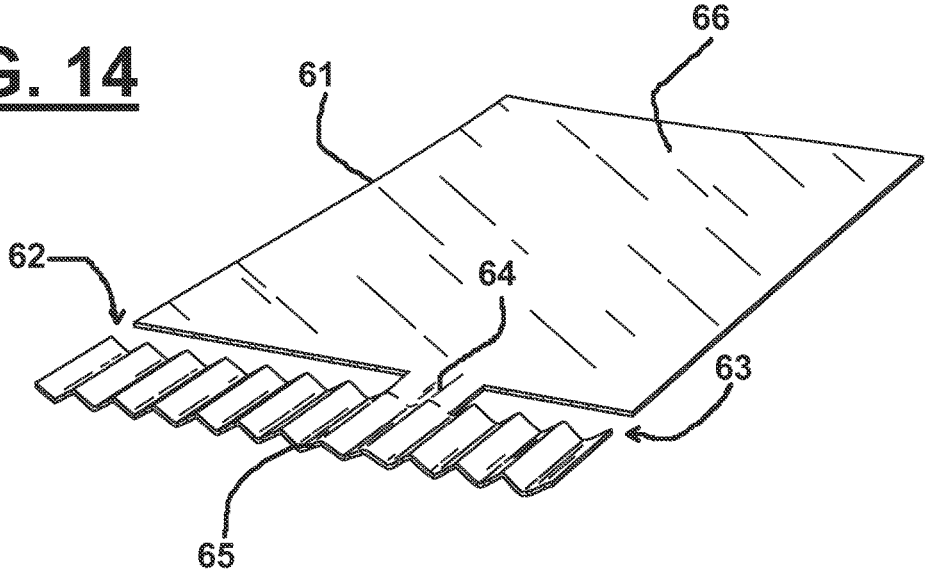
FIG. 15 is a partial perspective view of the second embodiment of the apparatus of the present invention and illustrating the method of the present invention.
Figure 16:
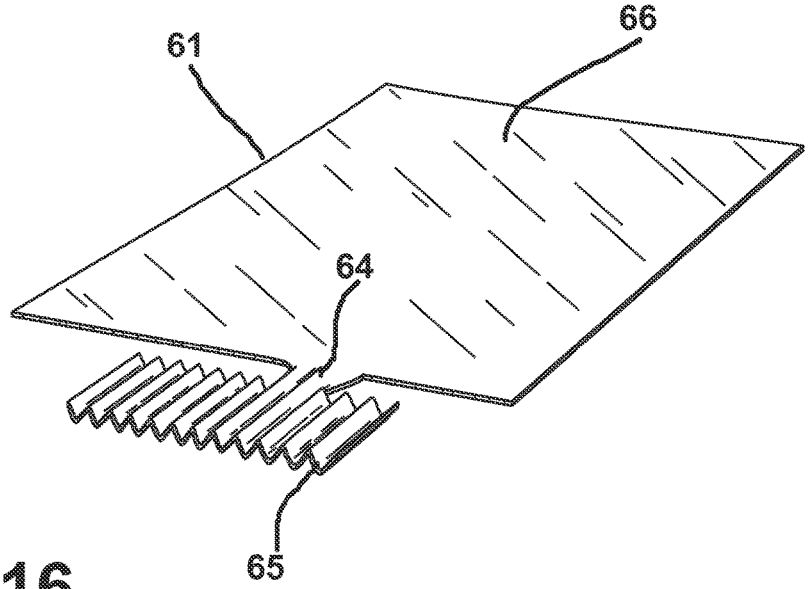
FIG. 16 is a partial perspective view of the second embodiment of the apparatus of the present invention and illustrating the method of the present invention.
Figure 17:
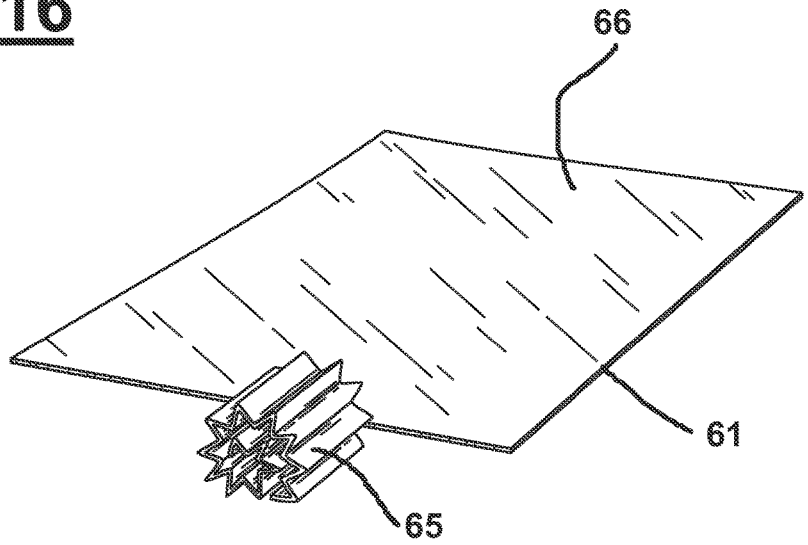
FIG. 17 is a partial perspective view of the second embodiment of the apparatus of the present invention and illustrating the method of the present invention.
Figure 18:
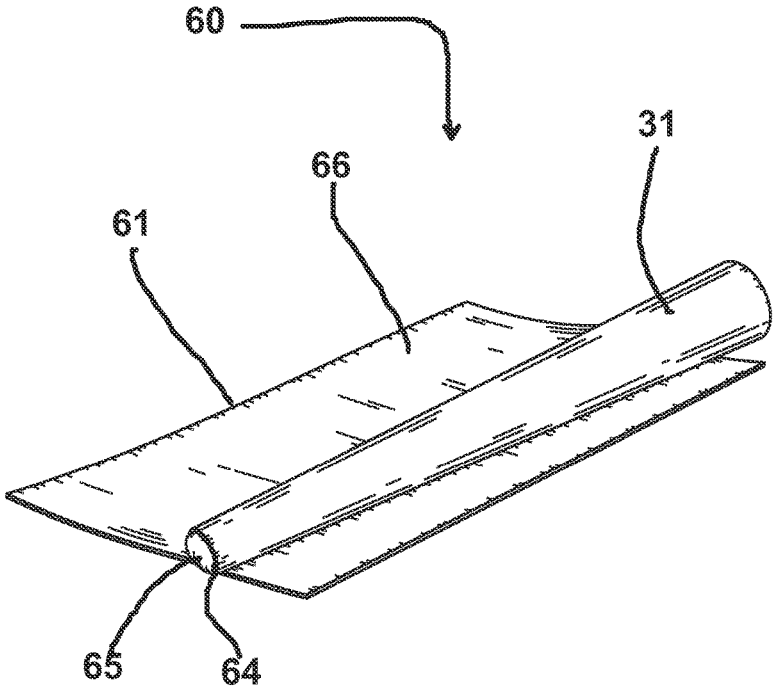
FIG. 18 is a partial perspective view of second embodiment of the apparatus of the present invention and illustrating the method of the present invention.
Figure 19:
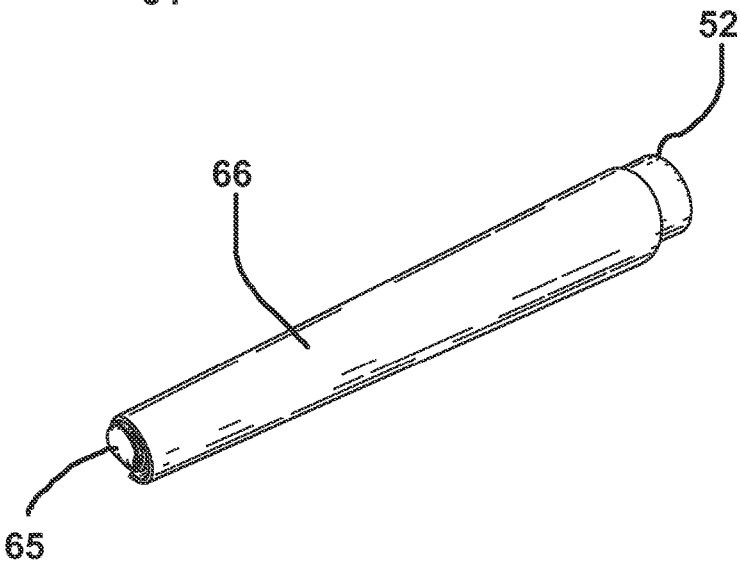
FIG. 19 is a partial perspective view of the second embodiment of the apparatus of the present invention and illustrating the method of the present invention.
Figure 20:
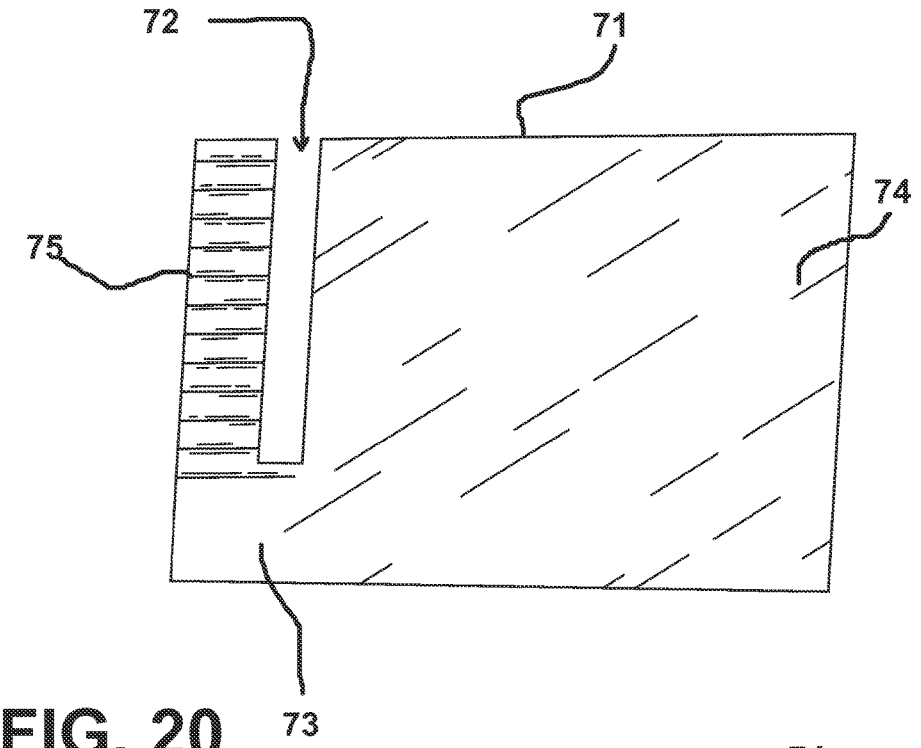
FIG. 20 is a plan view of a third embodiment of the apparatus of the present invention.
Figure 21:
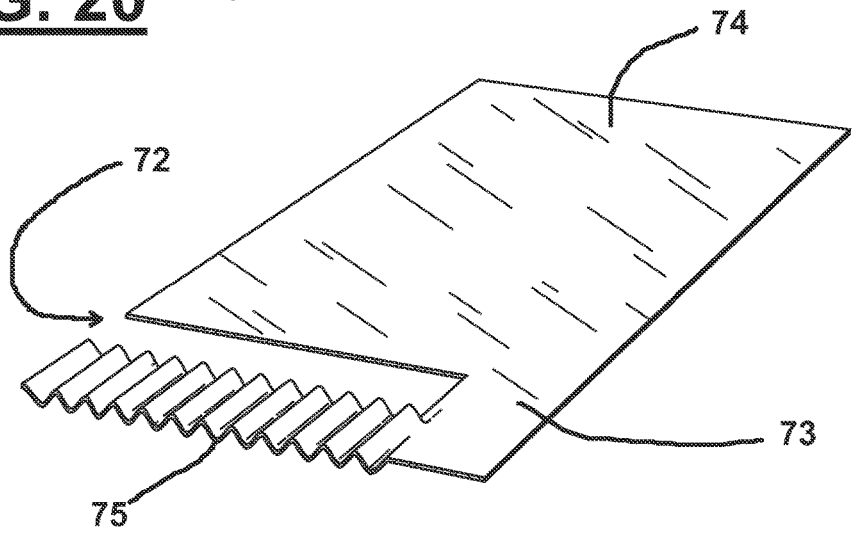
FIG. 21 is a partial perspective view of the third embodiment of the apparatus of the present invention and illustrating the method of the present invention.
Figure 22:
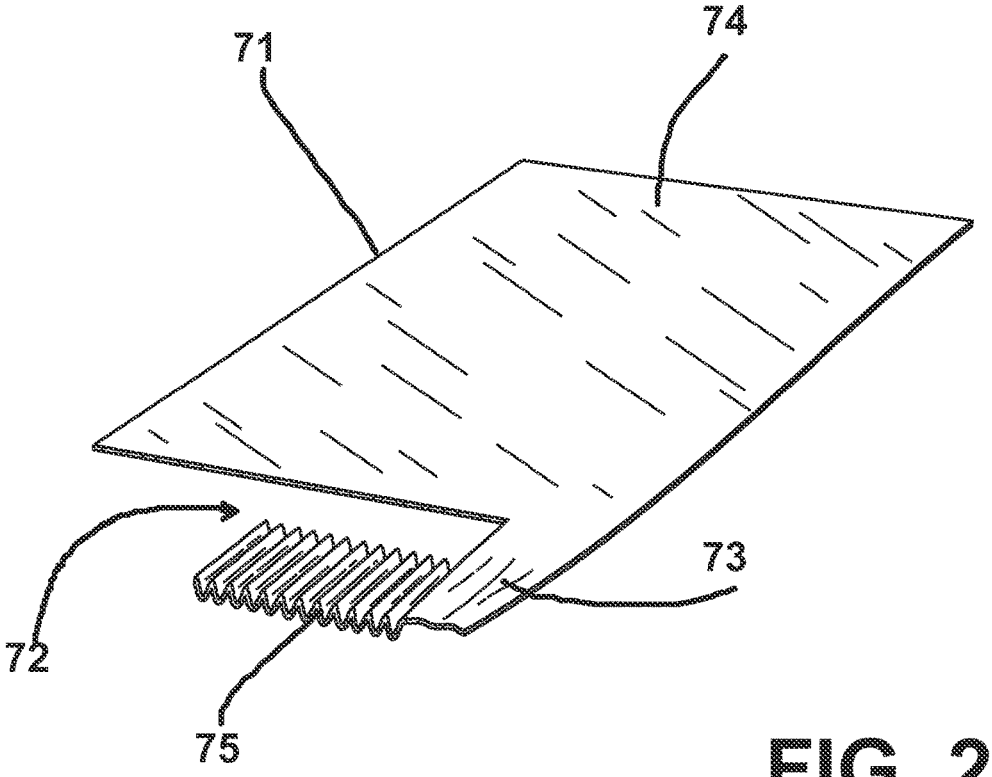
FIG. 22 is a partial perspective view of the third embodiment of the apparatus of the present invention.
Figure 23:
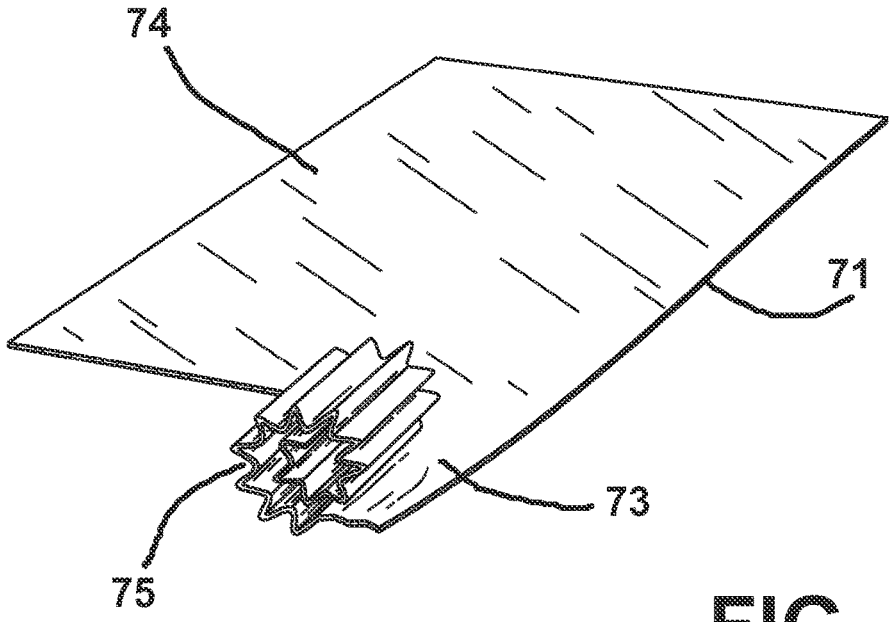
FIG. 23 is a partial perspective view of the third embodiment of the apparatus of the present invention illustrating the method of the present invention.

In FIG. 13, the finished article 10 can be smoked by placing the filter end 49 in the user's mouth and by lighting the closure at 48. A feature of the present invention is that the entire article 10 including the filter formed by small section 18 of sheet 11 can be smoked, as all of the article 10 of the first embodiment is of a smokable material.

The second embodiment of the apparatus of the present invention is shown in FIGS. 14-19, designated generally by the numeral 60. Whereas in the preferred embodiment of FIGS. 1-13, the scores or cuts 12, 13 are about equal in length, the sheet 61 in FIGS. 14-19 has a longer cut or score 62 and a smaller cut or score 63. Hinge or tab 64 is placed in between cuts 62, 63. As with the preferred embodiment, a smaller section 65 has corrugations or folds that enable the smaller section 65 to be gathered or collapsed (see FIGS. 16-18) for insertion into the smaller diameter opening 53 of form or mandrel 31 (see FIG. 18). As with the preferred embodiment, a larger section 66 of sheet 61 is wrapped around mandrel 31 (see FIGS. 18-19) to form a smokable shell that has a filter for enabling a user to place his or her custom tobacco material in the shell as with the preferred embodiment (see FIGS. 7-13). The same packaging of FIGS. 7-9 could be employed with the second embodiment 60 of FIGS. 14-19.

Figure 24:
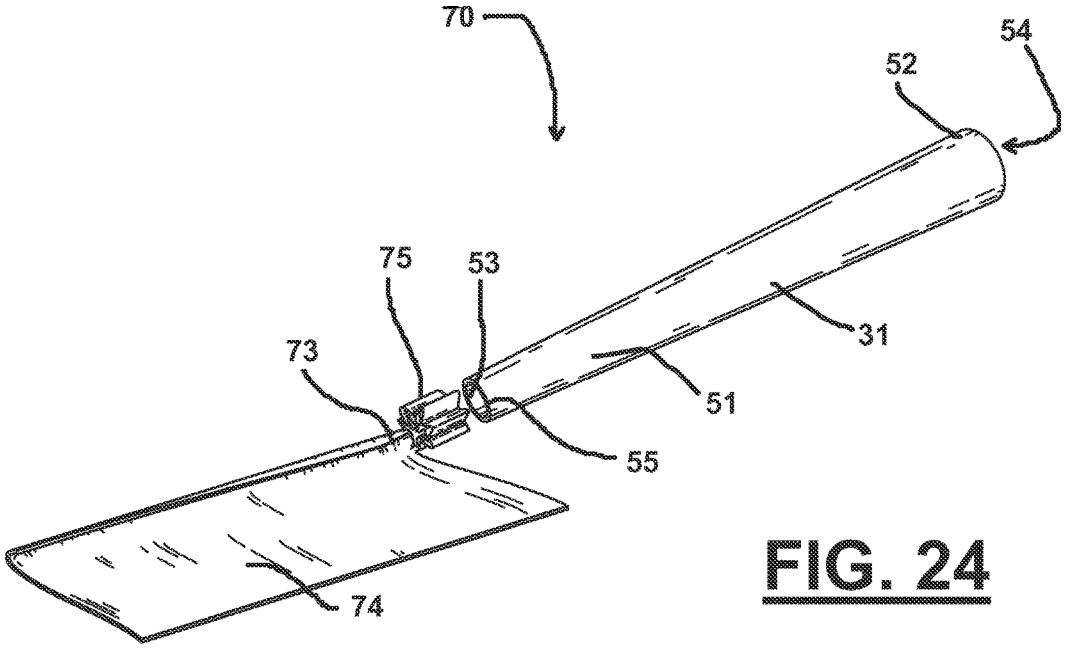
FIG. 24 is a partial perspective view of the third embodiment of the apparatus of the present invention illustrating the method of the present invention.
Figure 25:
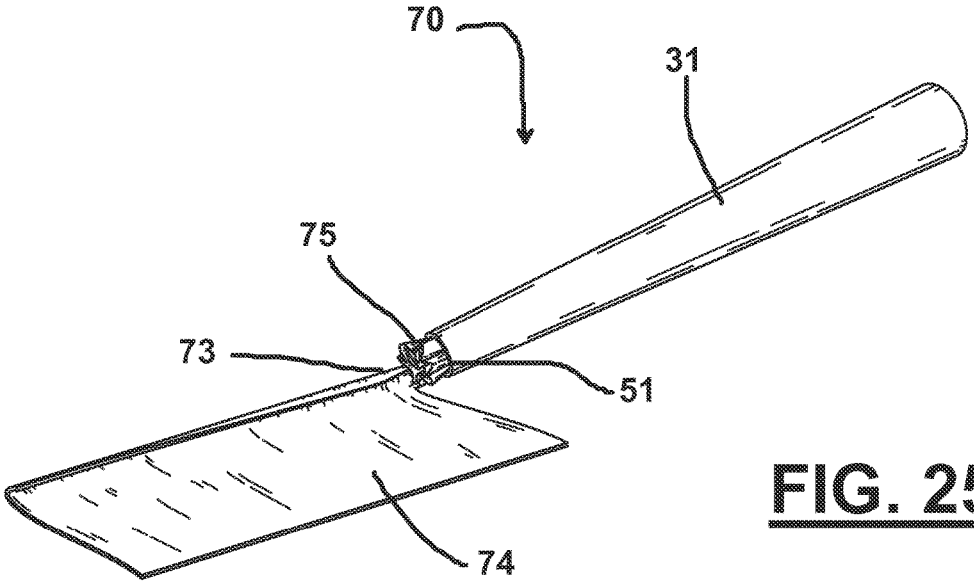
FIG. 25 is a partial perspective view of the third embodiment of the apparatus of the present invention illustrating the method of the present invention.
Figure 26:
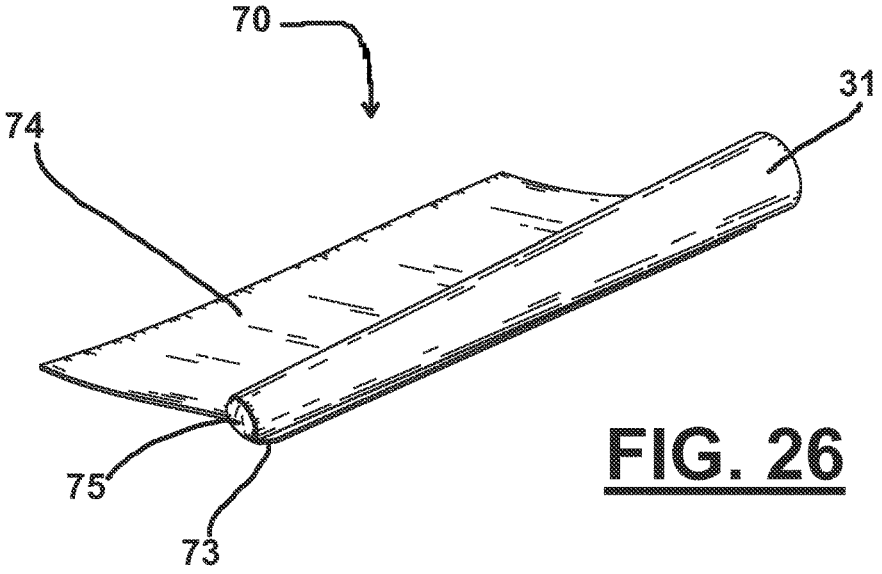
FIG. 26 is a perspective view of the third embodiment of the apparatus of the present invention.
Figure 27:
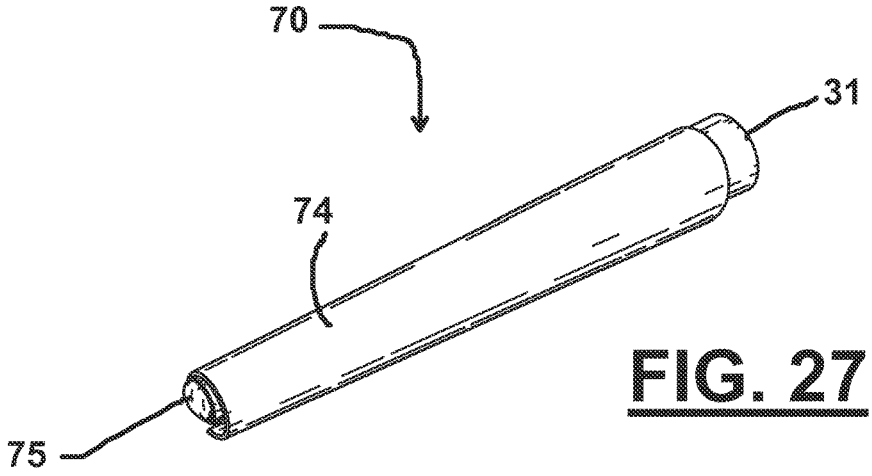
FIG. 27 is a perspective view of the third embodiment of the apparatus of the present invention.
Figure 28:
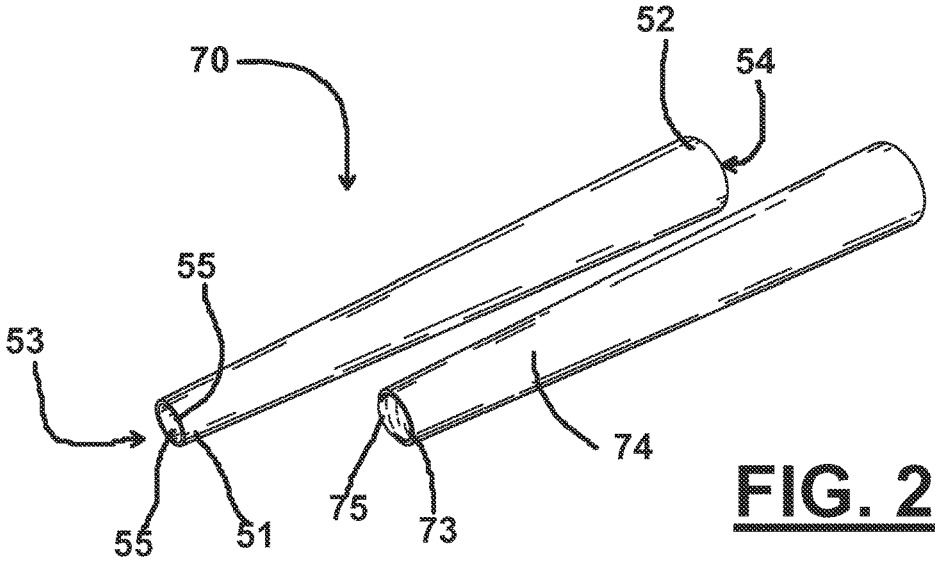
FIG. 28 is a perspective view of the third embodiment of the apparatus of the present invention.

FIGS. 20-28 show a third embodiment of the apparatus of the present invention, designated generally by the numeral 70. In the embodiment of FIGS. 20-23, instead of a pair of cuts or scores or slots, there is a single cut or slot or score 72 in sheet of material 71. A hinge or bridge or section or tab at 73 is placed in between larger sections 74 and smaller section 75. As with the embodiments of FIGS. 1-19, the smaller diameter section 75 can be corrugated or folded and then gathered or collapsed into a size and shape that will fit into smaller diameter opening 53 of form 31 as seen in FIGS. 24-25. The larger section 74 would then be wrapped around the form 31 as shown in FIGS. 26-27. As with the embodiments of FIGS. 1-19, hinge or bridge or section or tab 73 folds over circular rim 55 so that the larger section 74 of sheet 71 can wrap around the outer surface of form 31.

Figure 29:
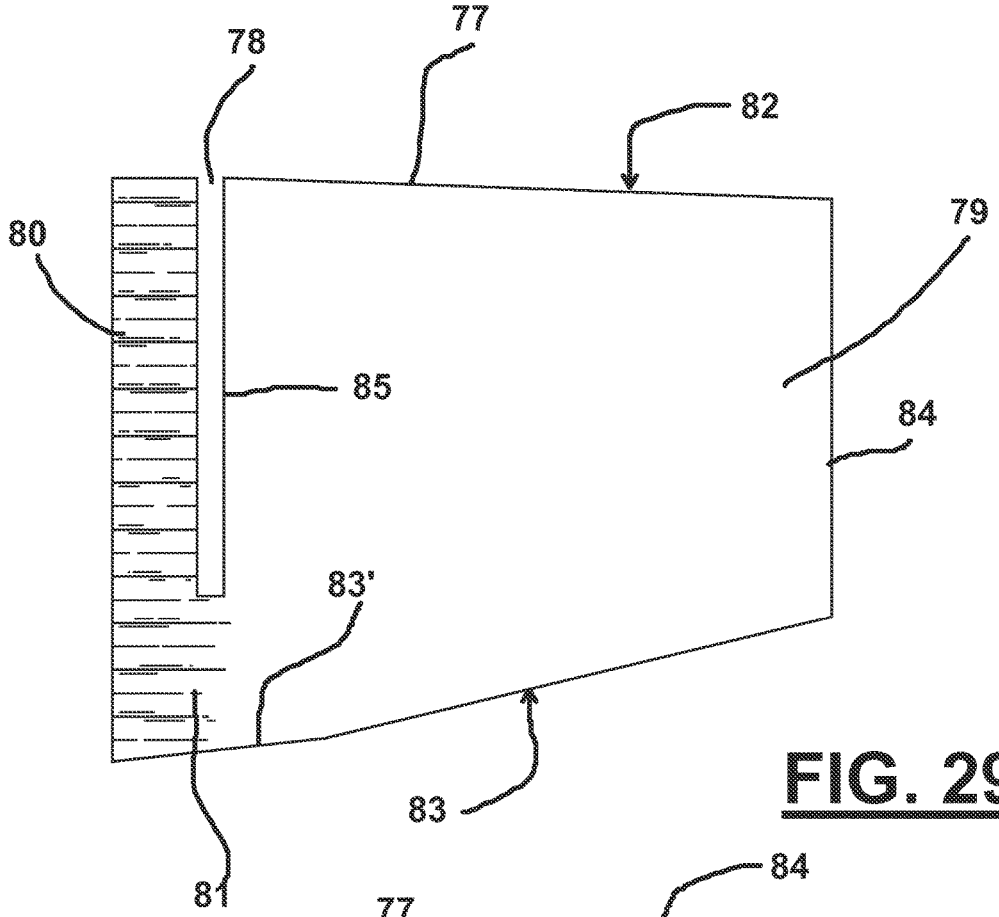
FIG. 29 is a partial plan view of a fourth embodiment of the apparatus of the present invention.
Figure 30:
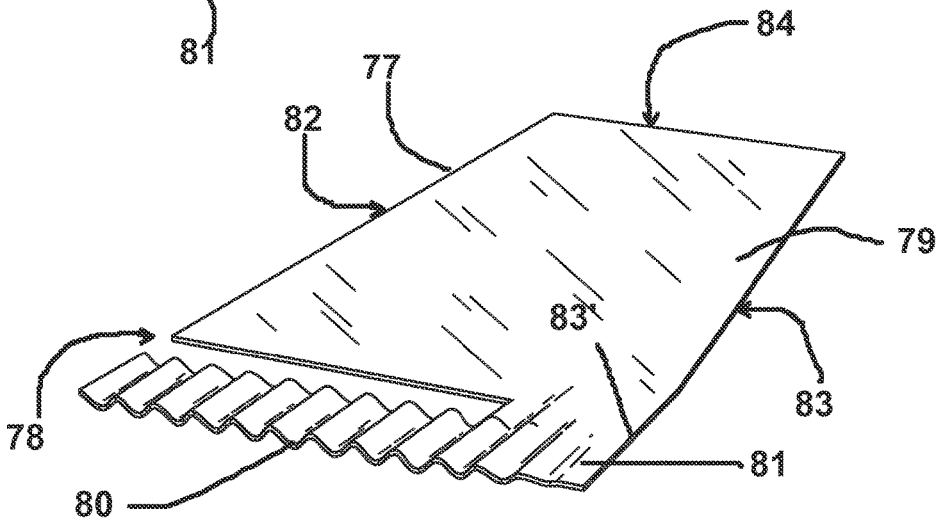
FIG. 30 is a partial perspective view of the fourth embodiment of the apparatus of the present invention illustrating the method of the present invention.
Figure 31:
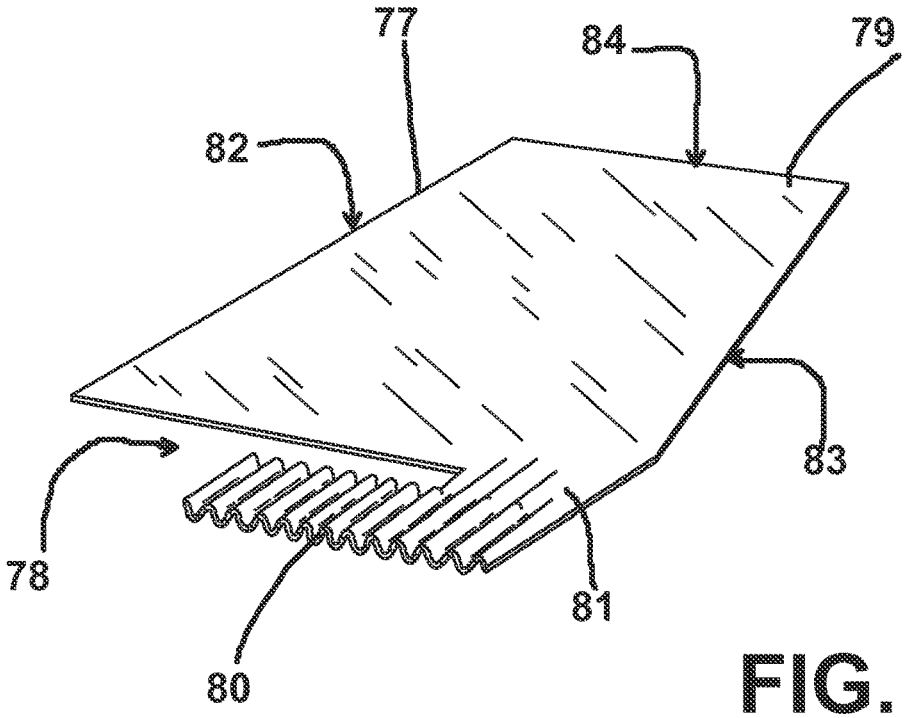
FIG. 31 is a partial perspective view of the fourth embodiment of the apparatus of the present invention illustrating the method of the present invention.
Figure 32:
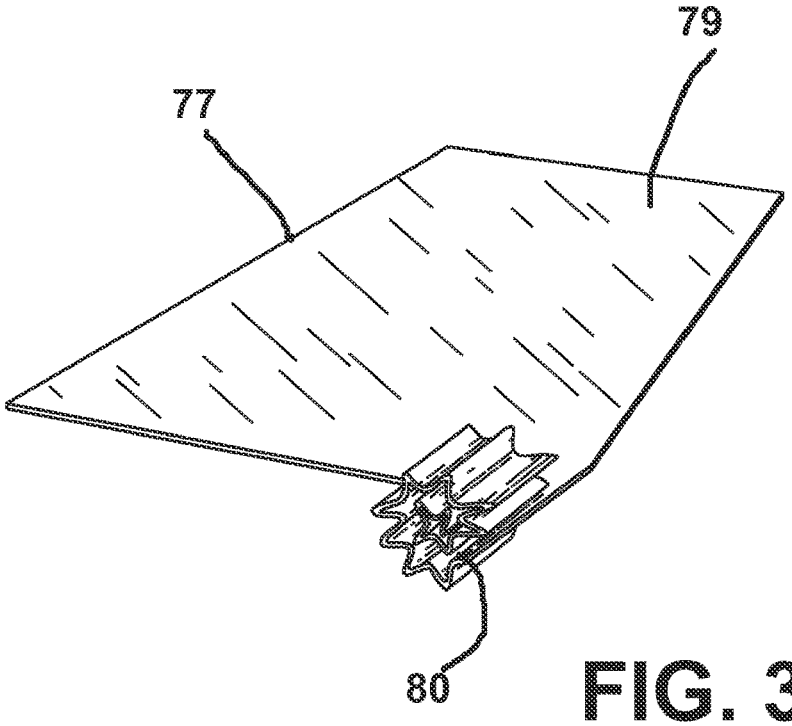
FIG. 32 is a partial perspective view of the fourth embodiment of the apparatus of the present invention illustrating the method of the present invention.
Figure 33:
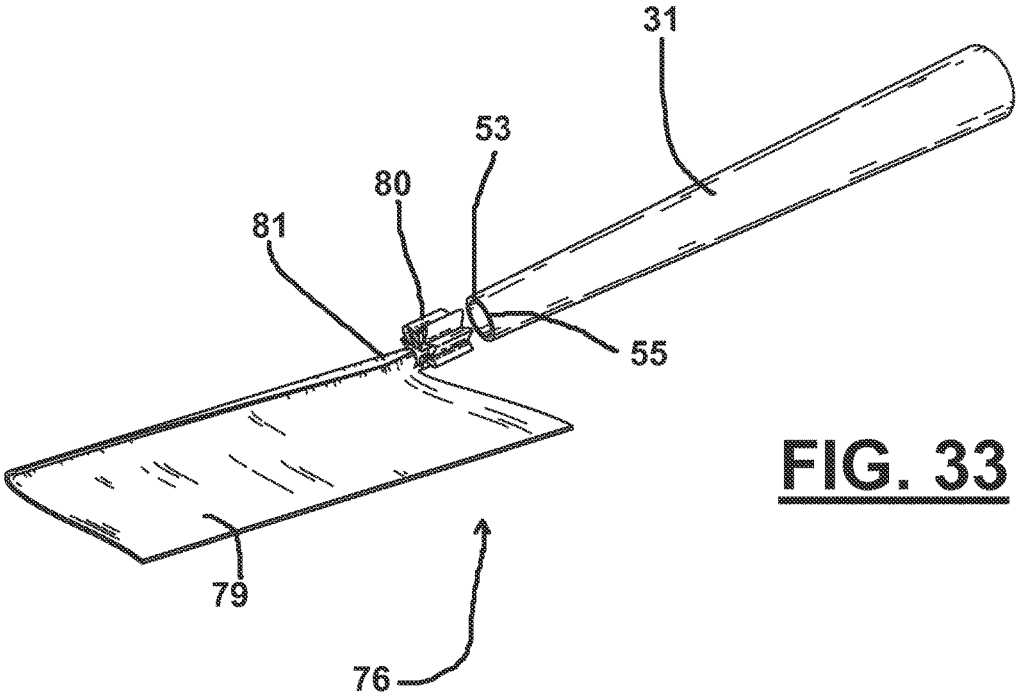
FIG. 33 is a partial perspective view of the fourth embodiment of the apparatus of the present invention illustrating the method of the present invention.
Figure 34:
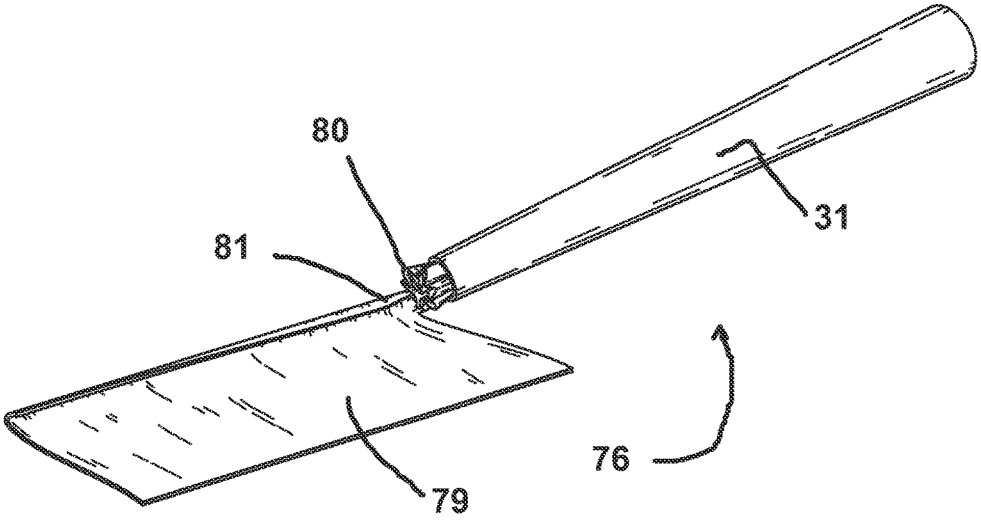
FIG. 34 is a partial perspective view of the fourth embodiment of the apparatus of the present invention illustrating the method of the present invention.
Figure 35:
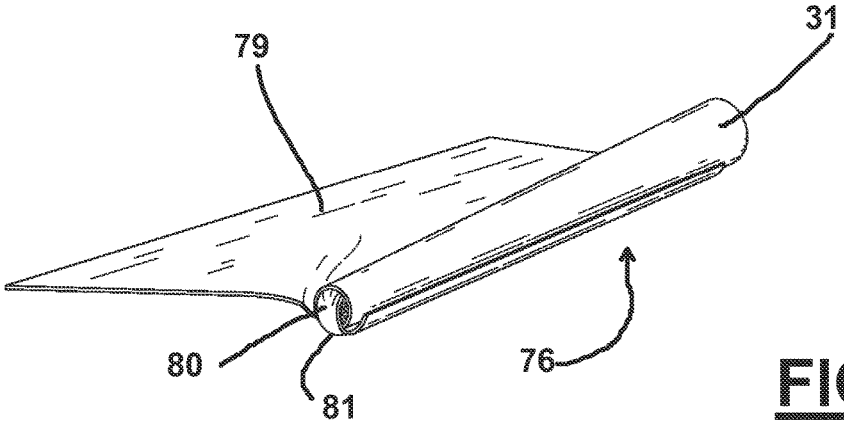
FIG. 35 is a partial perspective view of the fourth embodiment of the apparatus of the present invention illustrating the method of the present invention.
Figure 36:
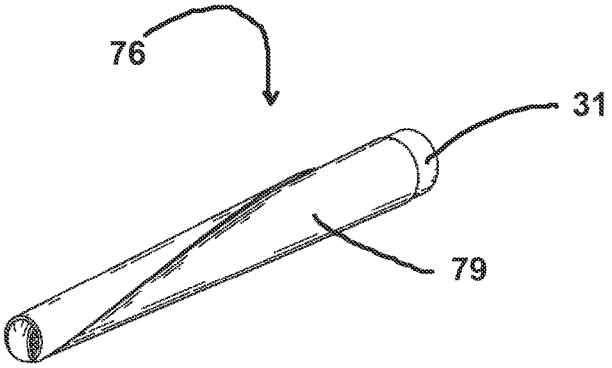
FIG. 36 is a partial perspective view of the fourth embodiment of the apparatus of the present invention illustrating the method of the present invention.
Figure 37:
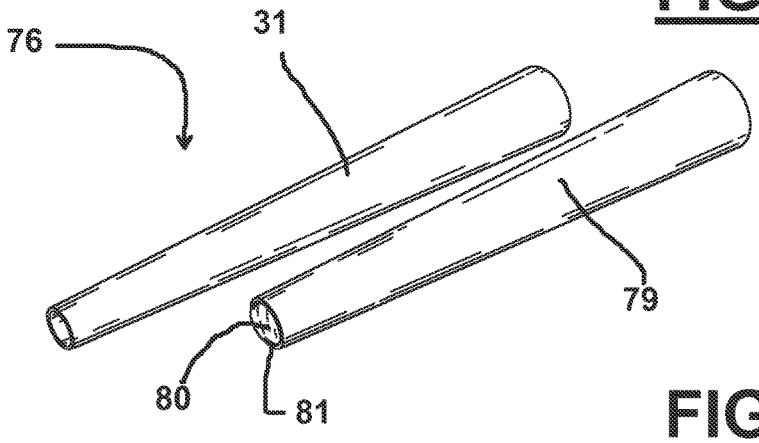
FIG. 37 is a partial perspective view of the fourth embodiment of the apparatus of the present invention illustrating the method of the present invention.
Figure 38:
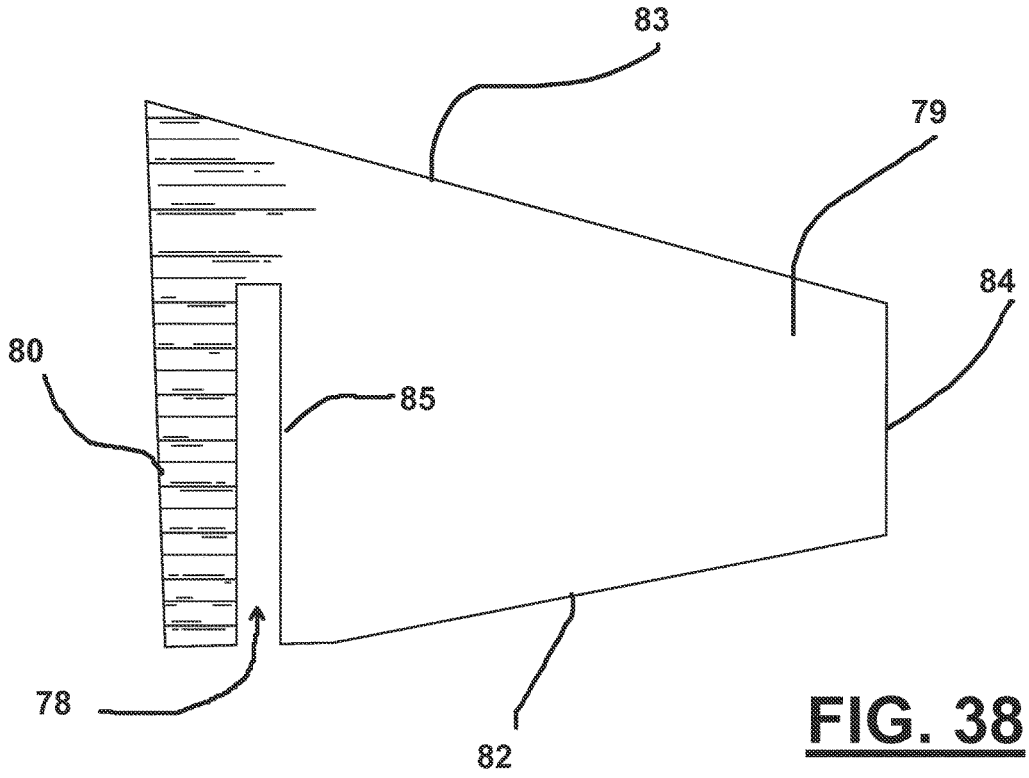
FIG. 38 is a partial plan view of an alternative embodiment to the fourth embodiment of the apparatus of the present invention.
Figure 39:
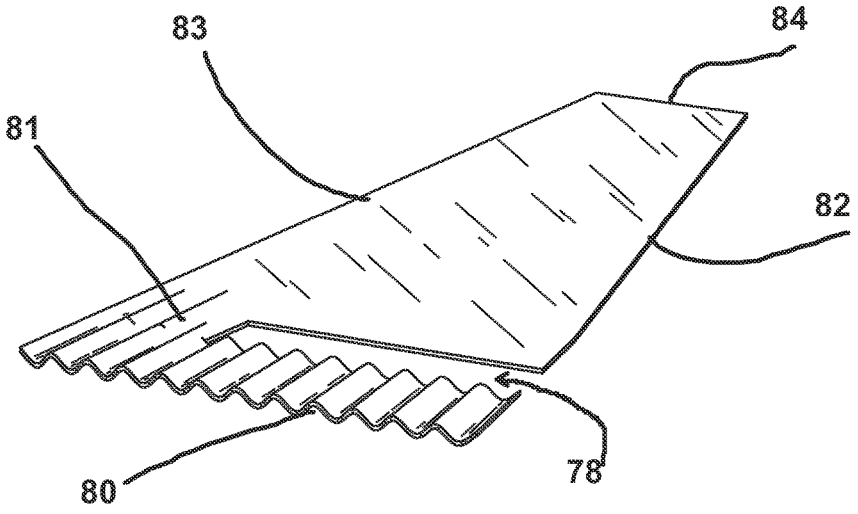
FIG. 39 is a partial perspective view of an alternative embodiment to the fourth embodiment of the apparatus of the present invention illustrating the method of the present invention.
Figure 40:
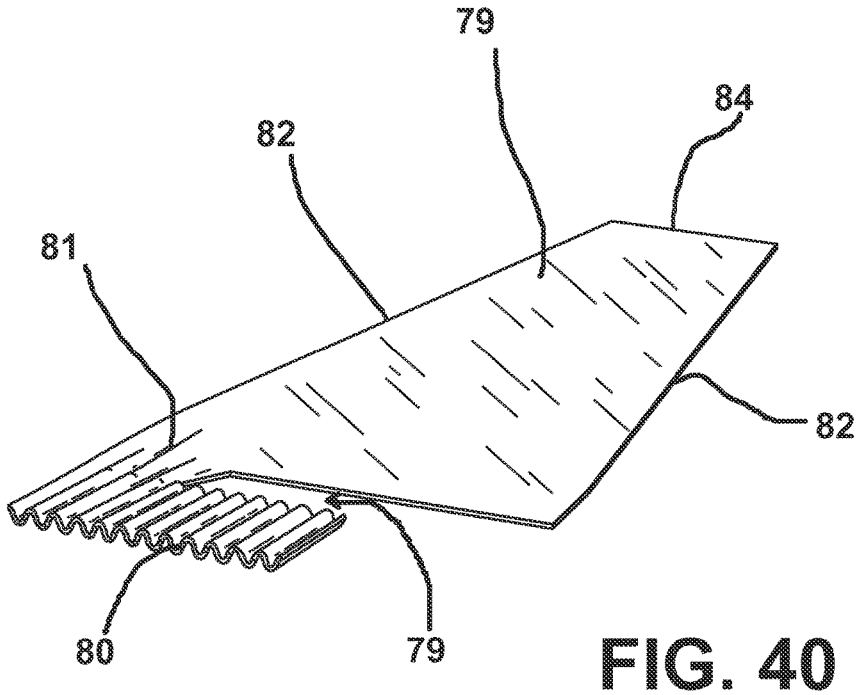
FIG. 40 is a partial perspective view of an alternative embodiment to the fourth embodiment of the apparatus of the present invention illustrating the method of the present invention.
Figure 41:
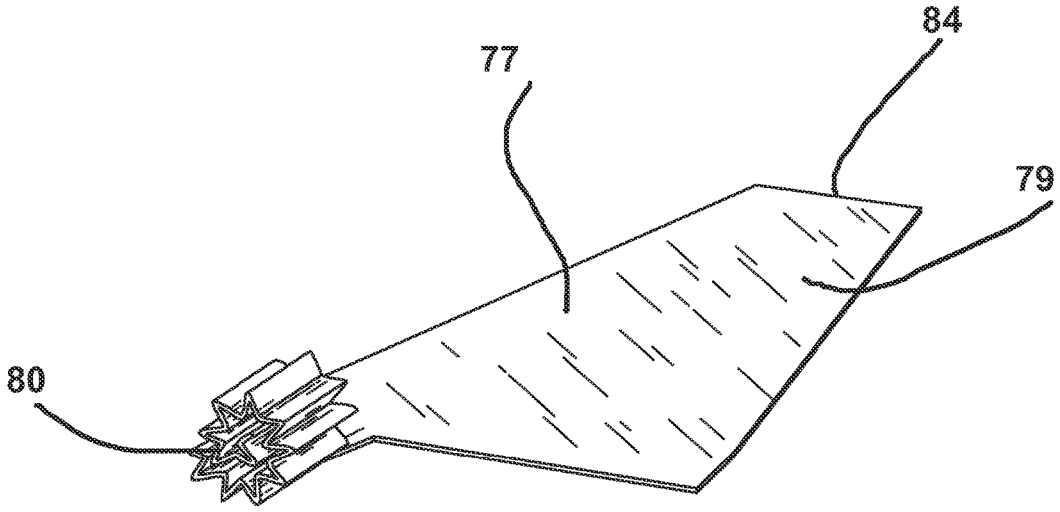
FIG. 41 is a partial perspective view of an alternative embodiment to the fourth embodiment of the apparatus of the present invention illustrating the method of the present invention.
Figure 42:
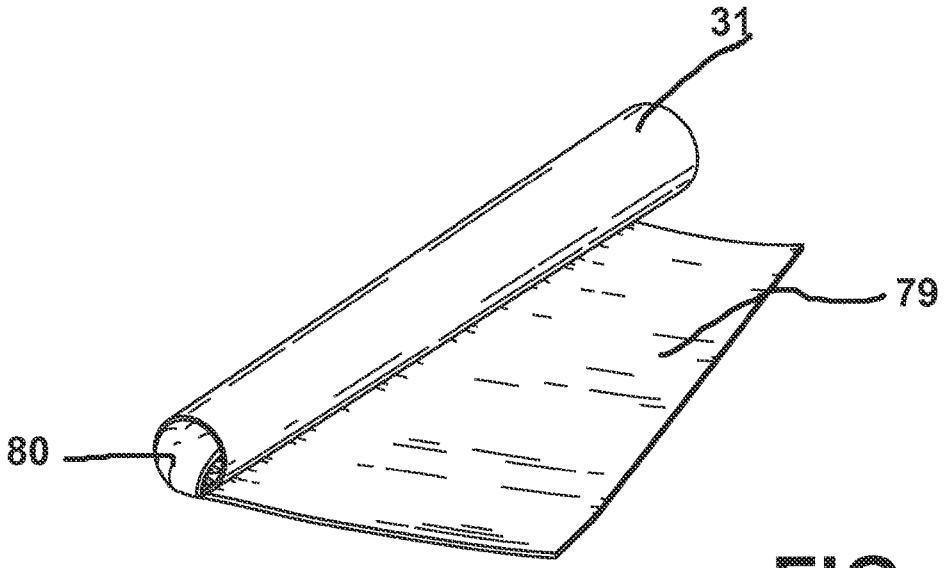
FIG. 42 is a partial perspective view of an alternative embodiment to the fourth embodiment of the apparatus of the present invention illustrating the method of the present invention.
Figure 43:
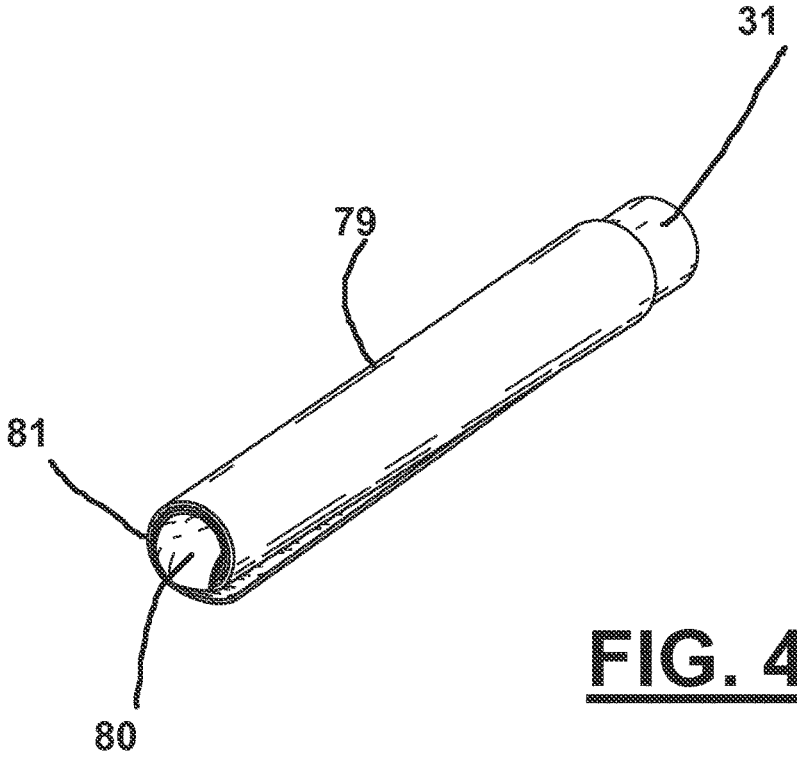
FIG. 43 is a partial perspective view of an alternative embodiment to the fourth embodiment of the apparatus of the present invention illustrating the method of the present invention.
Figure 44:
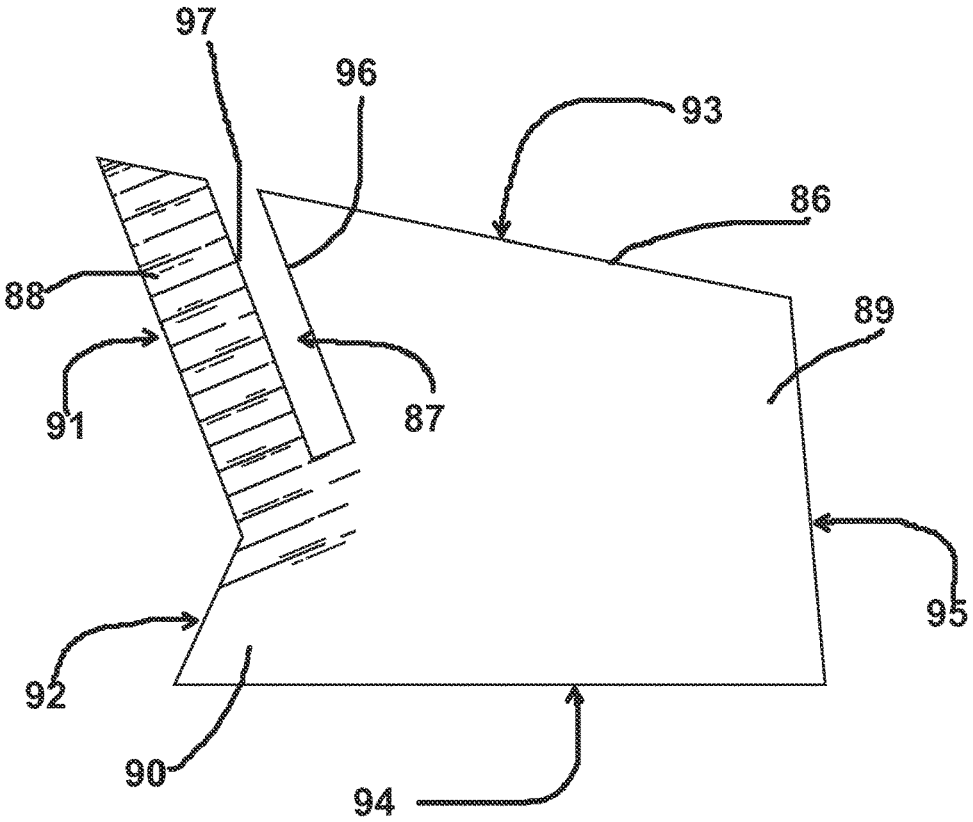
FIG. 44 is a partial plan view of a fifth embodiment of the apparatus of the present invention.

FIGS. 29-37 show a fourth embodiment that is somewhat similar to the embodiment of FIGS. 20-28. The difference between the embodiment of FIGS. 29-37and the embodiment of FIGS. 22-28 is that one side 83 of sheet 77, larger section 79 is angled relative to the other side edge 82 as seen in FIG. 29, and the side 83 has differing slopes for both portion 83' relative to portion 83". Embodiment of FIGS. 29-37 thus provide a smokable article 76 having a sheet of material 77 and a single cut or slot or score 78. The sheet of material 77 is thus divided into larger section 79 and smaller section 80 by cut or slot or score 78 and hinge or bridge or section or tab 81. In addition to the side edges 82 and 83 that form an acute angle, there is an end edge 84 that is spaced away from cut or slot or score 78 and an end edge 85 that is next to the cut or slot or score 78. As with the embodiments of FIGS. 1-28, the smaller section 80 can be collapsed, folded or gathered to fit into the smaller diameter opening 53 of form 31 as shown in FIGS. 33 and 34. The larger diameter section 79 then folds at hinge or bridge or section or tab 81 so that the larger section 79 can wrap around form 31 as shown in FIGS. 35 and 36.

FIGS. 38-43 show an alternative embodiment to the fourth embodiment. The difference between the embodiment of FIGS. 38 to 43 and the embodiment of FIGS. 29-37 is that one side 83 of sheet 77 has a single slope.

Figure 45:
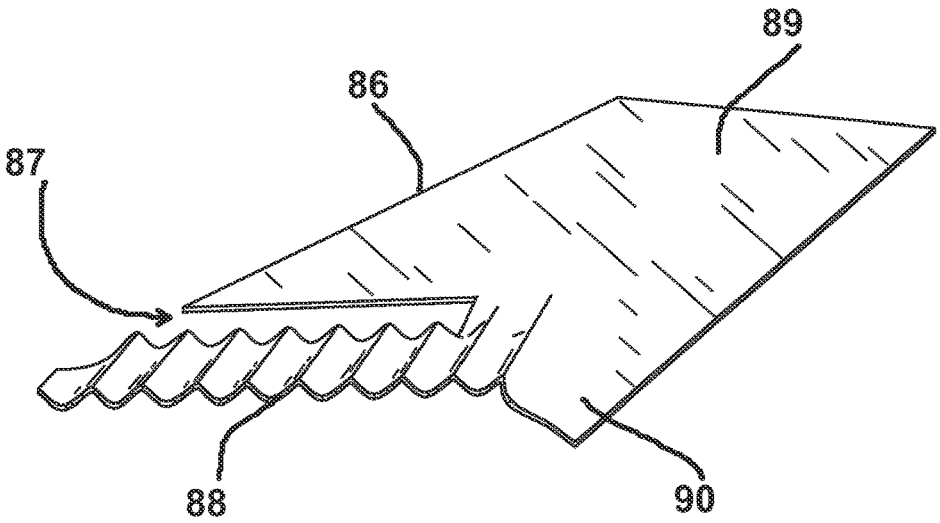
FIG. 45 is a partial perspective view of the fifth embodiment of the apparatus of the present invention illustrating the method of the present invention.
Figure 46:
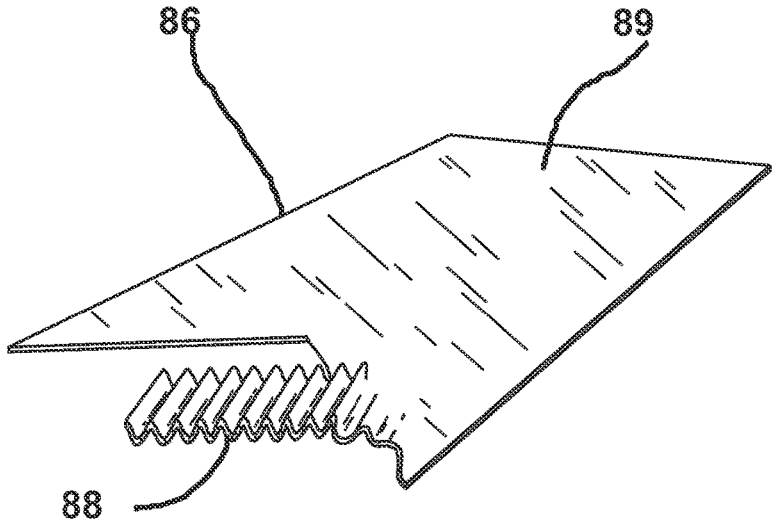
FIG. 46 is a partial perspective view of the fifth embodiment of the apparatus of the present invention illustrating the method of the present invention.
Figure 47:
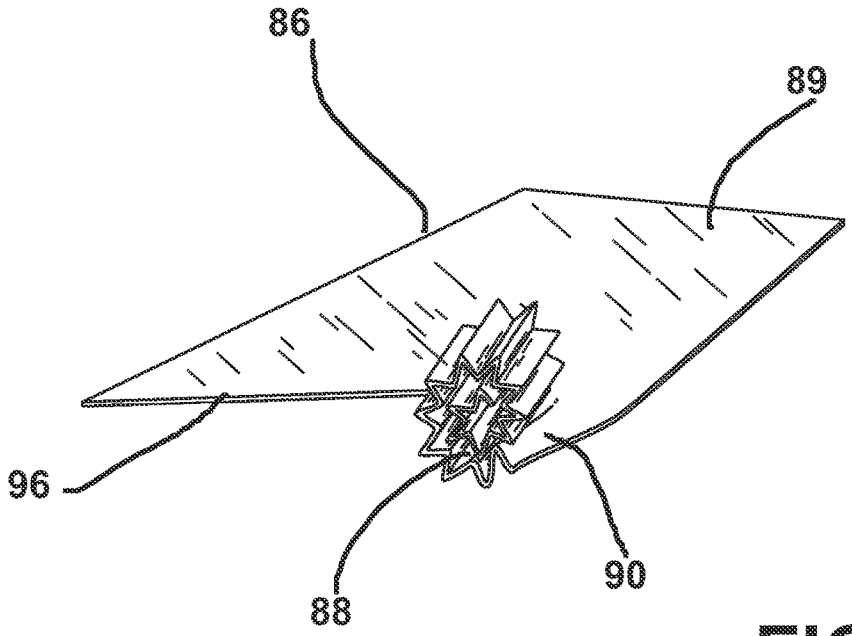
FIG. 47 is a partial perspective view of the fifth embodiment of the apparatus of the present invention illustrating the method of the present invention.
Figure 48:
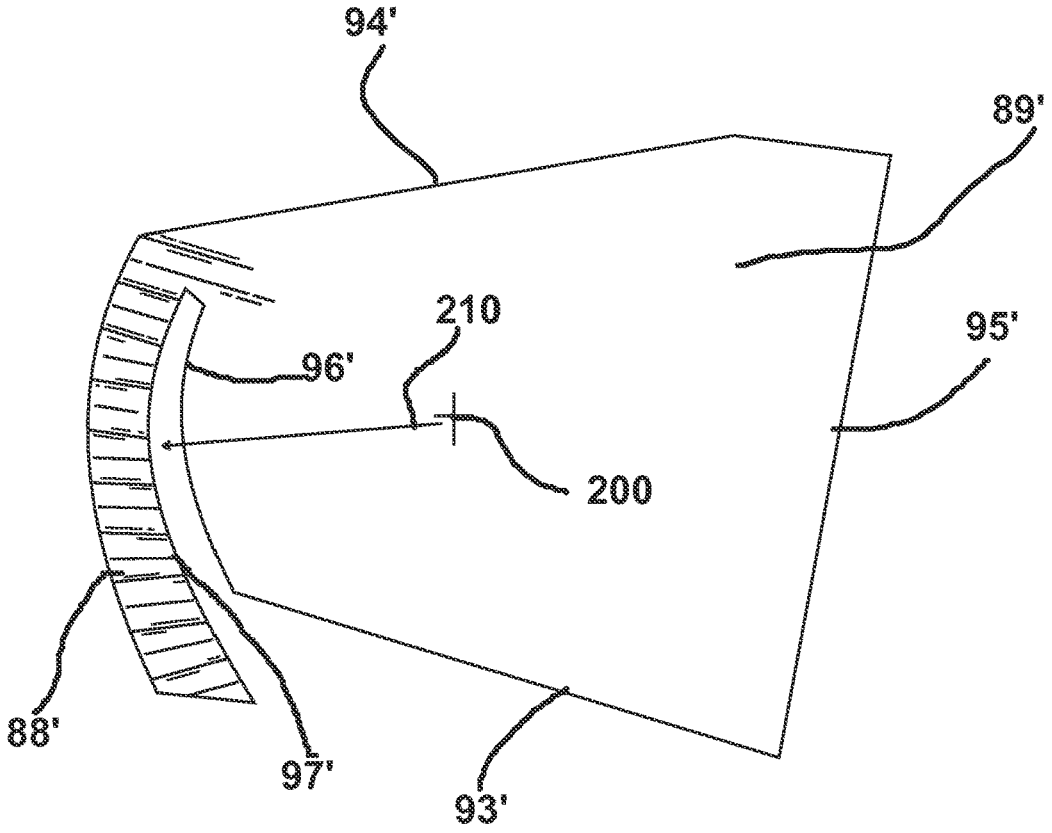
FIG. 48 is a partial plan view of an alternative embodiment to the fifth embodiment of the apparatus of the present invention.
Figure 49:
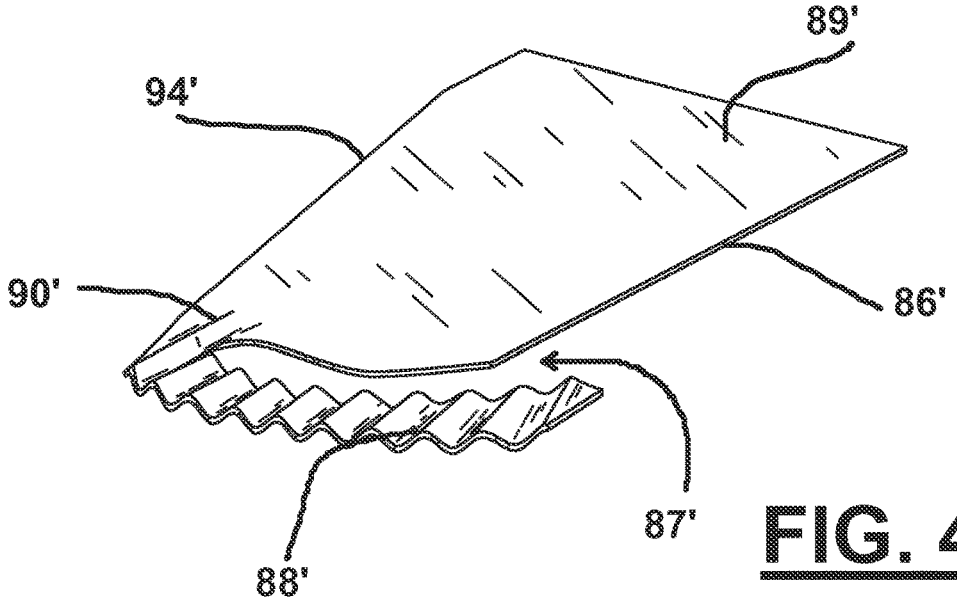
FIG. 49 is a partial perspective view of an alternative embodiment to the fifth embodiment of the apparatus of the present invention illustrating the method of the present invention.
Figure 50:
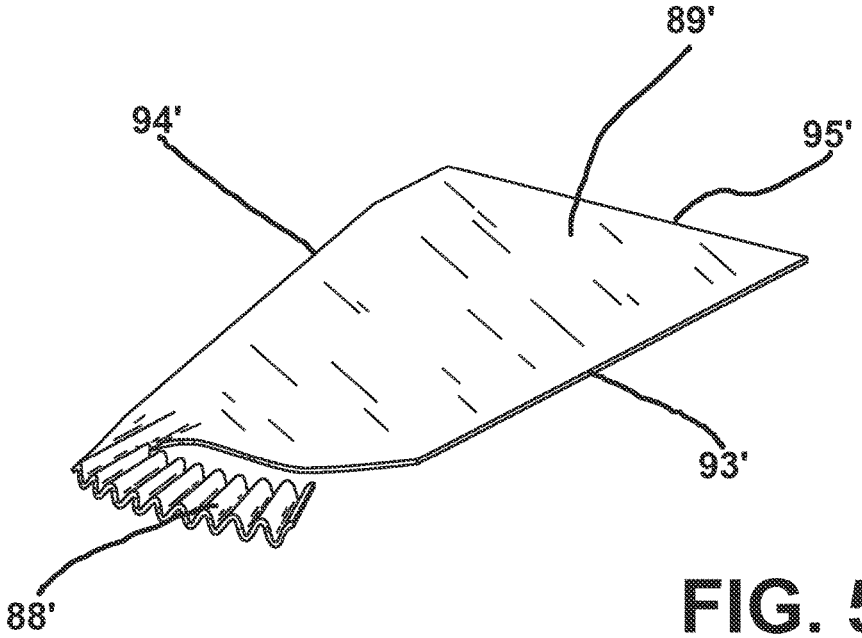
FIG. 50 is a partial perspective view of an alternative embodiment to the fifth embodiment of the apparatus of the present invention illustrating the method of the present invention.
Figure 51:
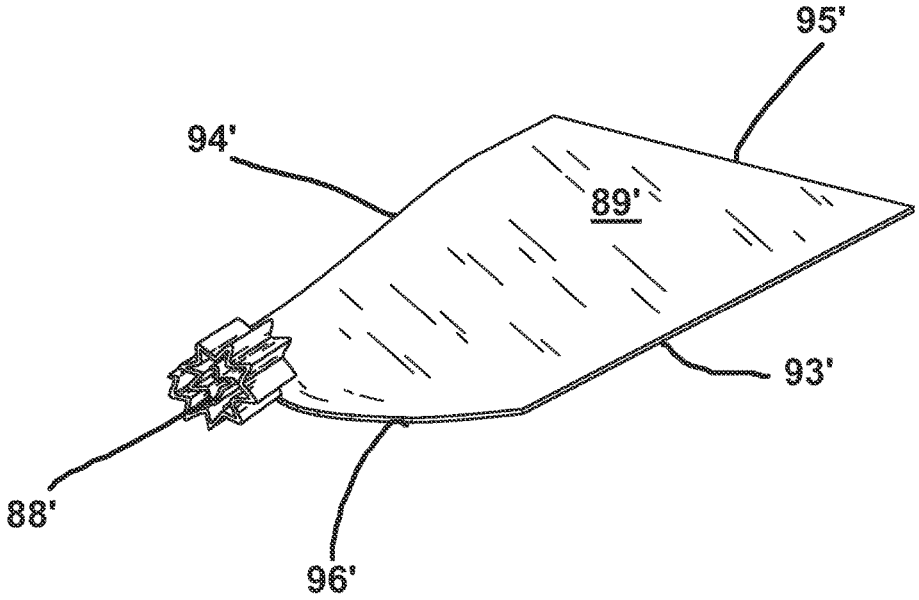
FIG. 51 is a partial perspective view of an alternative embodiment to the fifth embodiment of the apparatus of the present invention illustrating the method of the present invention.
Figure 52:
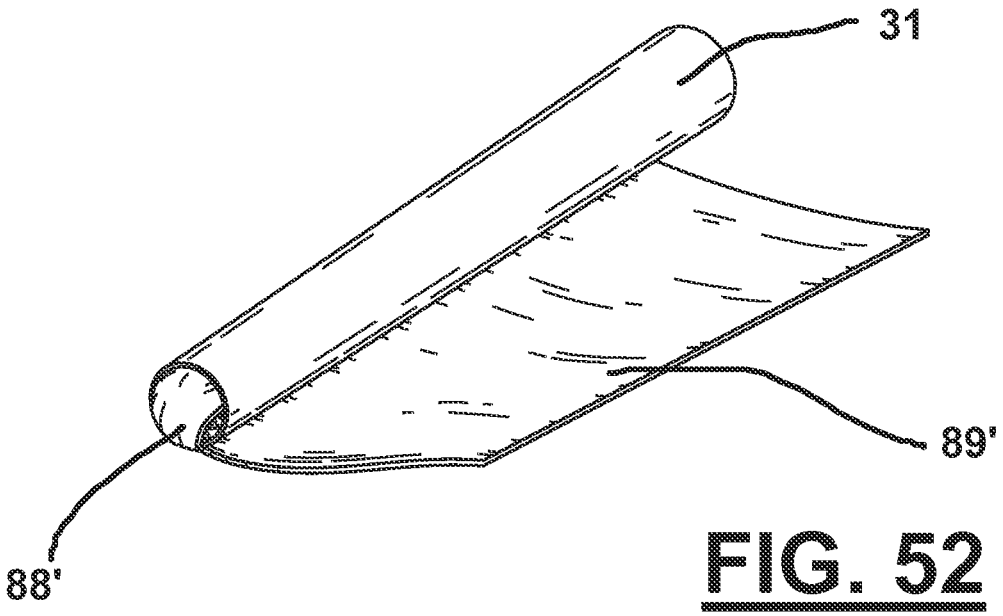
FIG. 52 is a partial perspective view of an alternative embodiment to the fifth embodiment of the apparatus of the present invention illustrating the method of the present invention.
Figure 53:
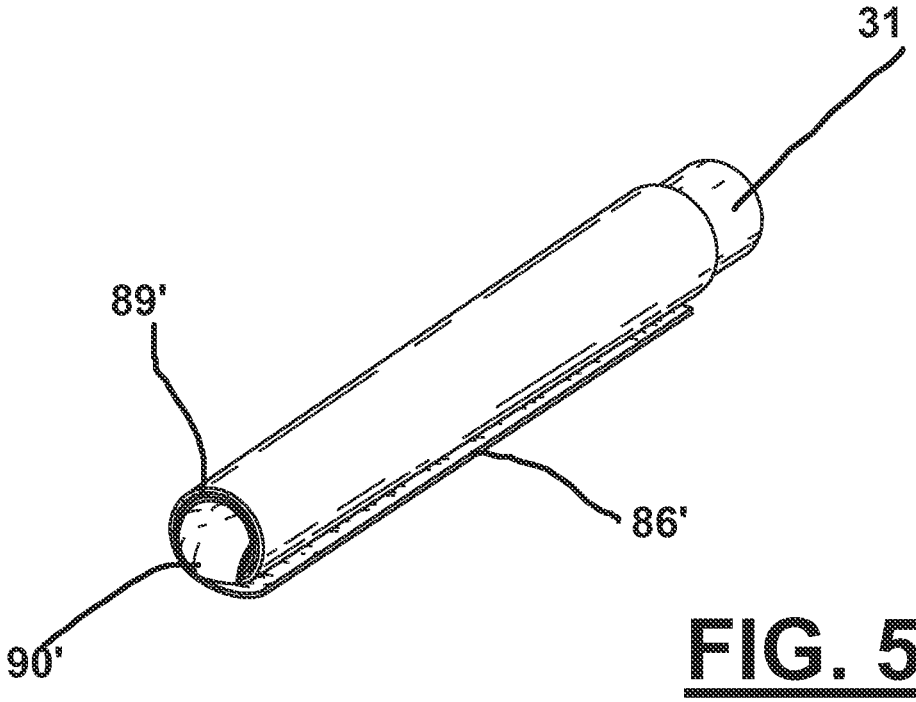
FIG. 53 is a partial perspective view of an alternative embodiment to the fifth embodiment of the apparatus of the present invention illustrating the method of the present invention.

FIGS. 44-47 show a fifth embodiment of the apparatus of the present invention that is similar to the embodiment of FIGS. 29-37. The embodiment of FIGS. 44-47 provides an irregularly shaped sheet of material 86 having a cut or slot or score at 87 that divides the sheet of material 86 into a smaller section 88 and a larger section 89. A hinge or bridge or section or tab at 90 extends between cut or slot or score 87 and edge 94. There are a plurality of edges of sheet 86 including edges 91, 92, 93, 94, 95, 96 and 97. The edges 91, 92 form an obtuse angle. The edges 93, 94 form an acute angle. The edges 94 and 95 can form an acute angle or a right angle. The edges 93, 95 can form an obtuse angle. The edges 93, 96 can form an acute angle. As with the embodiments of FIGS. 1-43, the smaller section 88 can be collapsed or gathered as shown in FIGS. 45-47 for insertion into the smaller diameter opening 53 of form 31 as was shown in the embodiment of FIGS. 29-37. Larger section 89 would then be wrapped around a form 31 as was the case with the fourth embodiment of FIGS. 29-37.

FIGS. 48-53 show an alternative embodiment to the fifth embodiment of the apparatus of the present invention that shown in FIGS. 44-47. The embodiment of FIGS. 48-53 provides a curve linearly shaped sheet of material 86' having a curve linear cut or slot or score at 87' that divides the sheet of material 86' into a smaller section 88' and a larger section 89'. A hinge or bridge or section or tab at 90' extends between cut or slot or score 87' and edge 94'. There are a plurality of edges of sheet 86' including edges 91', 92', 93', 94', 95', 96' and 97'. The edges 96', 97' form an arc having a radius of curvature R 210 with center 200. As with the embodiments of FIGS. 1-37, the smaller section 88' can be collapsed or gathered as shown in FIGS. 49-52 for insertion into the smaller diameter opening 53 of form 31 as was shown in the embodiment of FIGS. 29-37. Larger section 89' would then be wrapped around a form 31 as was the case with the fourth embodiment of FIGS. 29-37.

Figure 54:
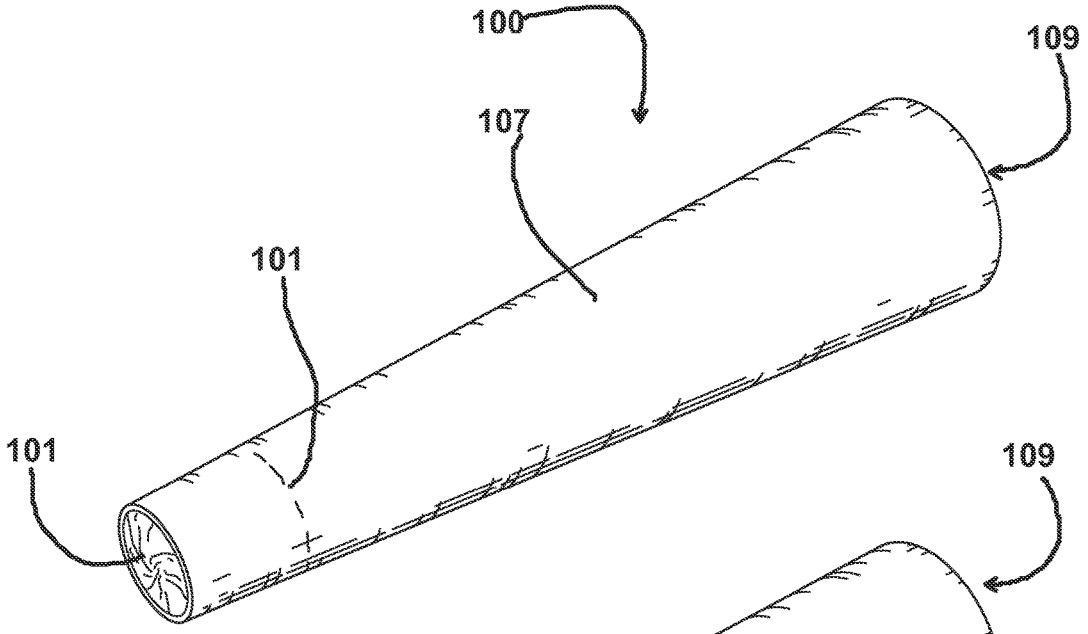
FIG. 54 is a partial perspective view of a sixth embodiment of the apparatus of the present invention.
Figure 55:
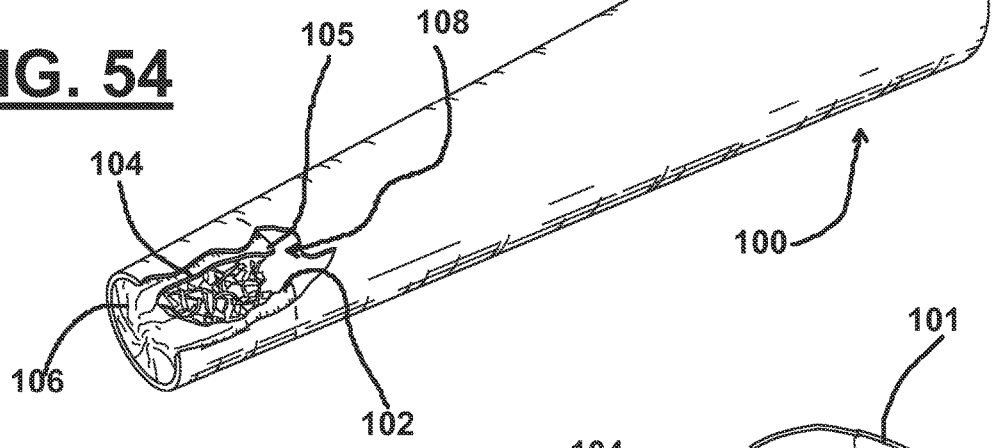
FIG. 55 is a partial perspective view of the sixth embodiment of the apparatus of the present invention.
Figure 56:
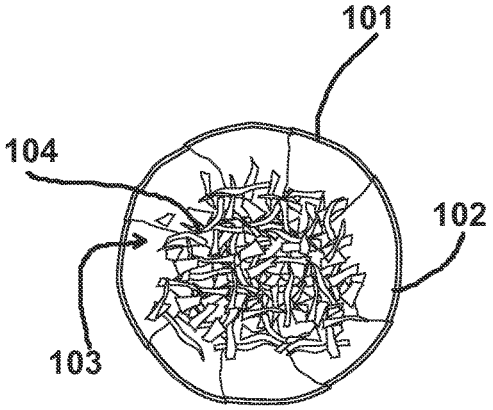
FIG. 56 is a sectional view of the sixth embodiment of the apparatus of the present invention.
Figure 57:
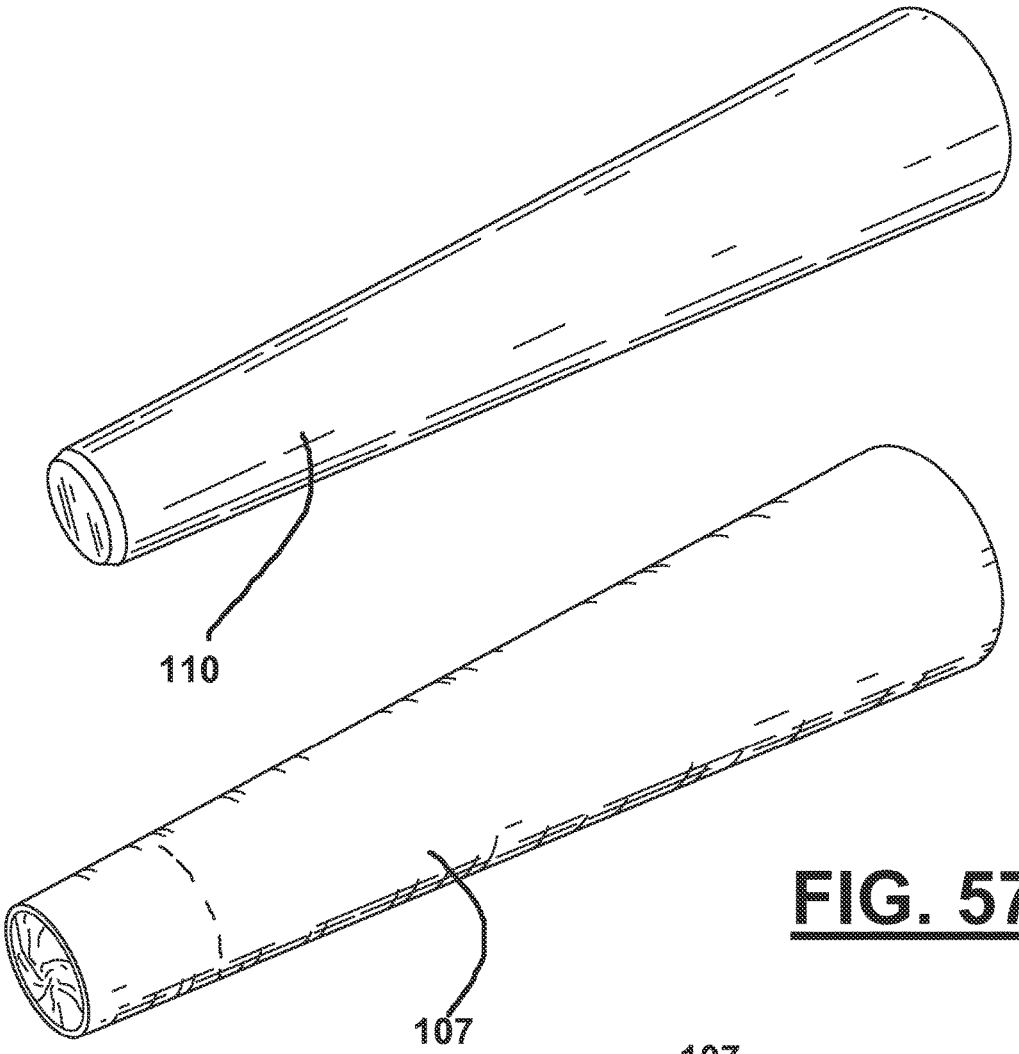
FIG. 57 is a perspective view of the sixth embodiment of the apparatus of the present invention.

FIGS. 54-66 show a sixth embodiment of the apparatus the present invention designated generally by the numeral 100. Smokable article 100 provides a filter element 101 that attaches to outer frustoconical sleeve 102. Sleeve 102 has interior 103 that can be filled with a tobacco filler material. The sleeve 102 surrounds interior 103 and tobacco filler 104 in FIGS. 54 and 55. The filter element 101 has a closed end 106 and an annularrim 105 defining an open end into which the tobacco filler material 104 can be placed. Thus, the filter element 101 itself uses tobacco filler 104 as the filter media.

Figure 58:
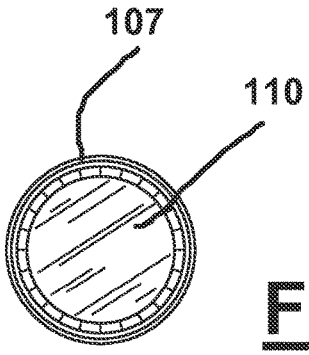
FIG. 58 is a sectional view of the sixth embodiment of the apparatus of the present invention.

The filter element 101 can be joined to a tobacco shell, cone, or smokable material shell or cone 107 having hollow bore 108. The tobacco shell 107 has larger diameter opening 109 opposite filter element 101. A frustoconically shaped form 110 can be placed in the hollow bore 108 of shell 107 as seen in FIG. 58.

Figure 59:
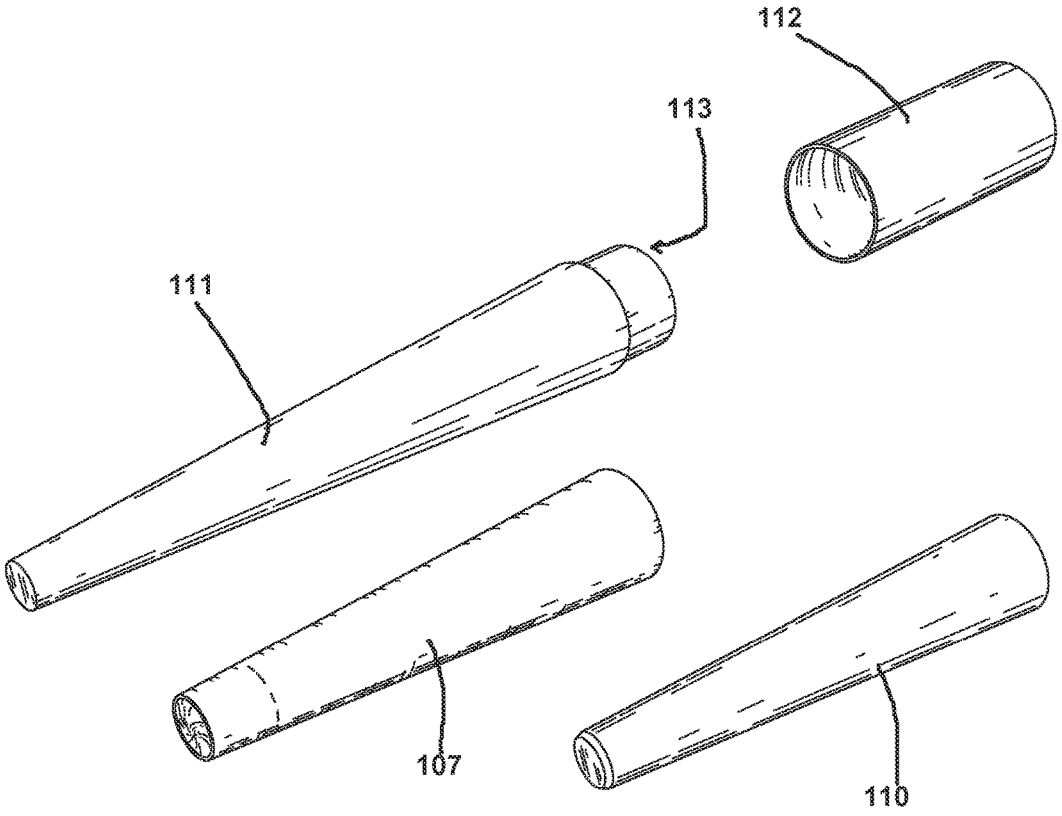
FIG. 59 is an exploded perspective view of the sixth embodiment of the apparatus of the present invention.

As shown in FIG. 59, package 111 can be frustoconically shaped. The package 111 has interior 113 that can be closed using cap 112. The interior 113 would be sized and shaped to contain the combination of shell 107 and form 110.

Figure 60:
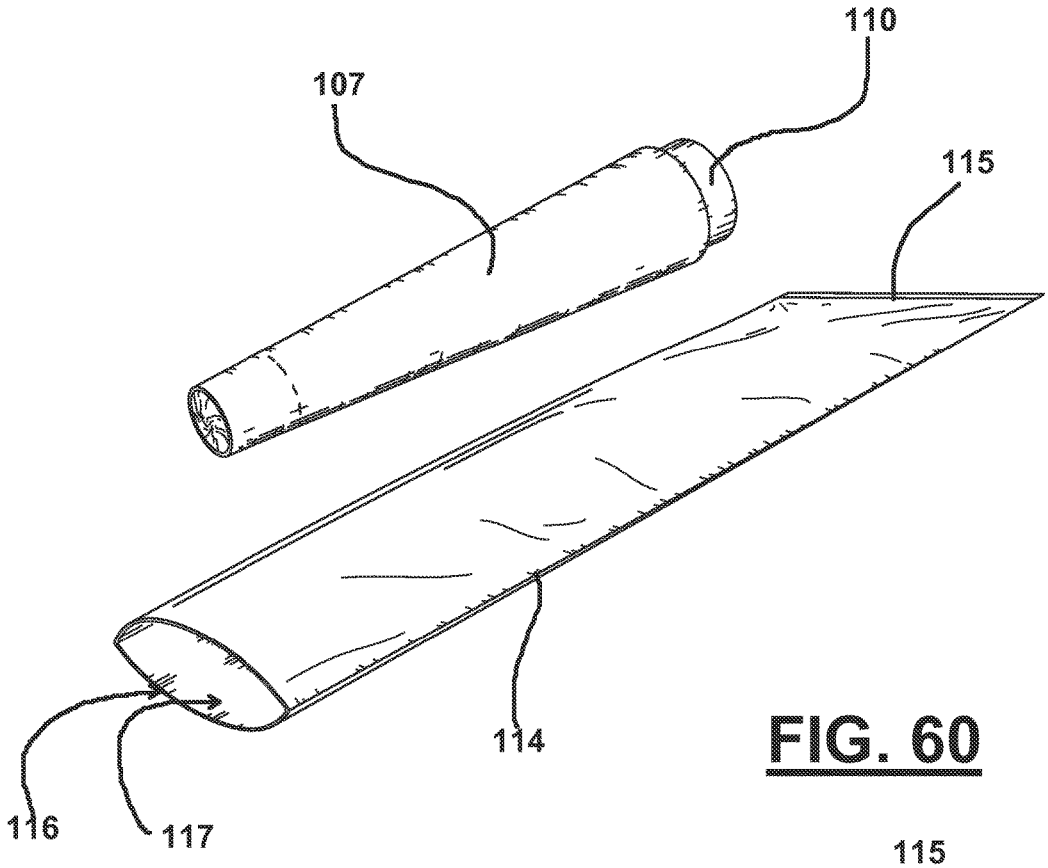
FIG. 60 is a perspective view of the sixth embodiment of the apparatus of the present invention.
Figure 61:
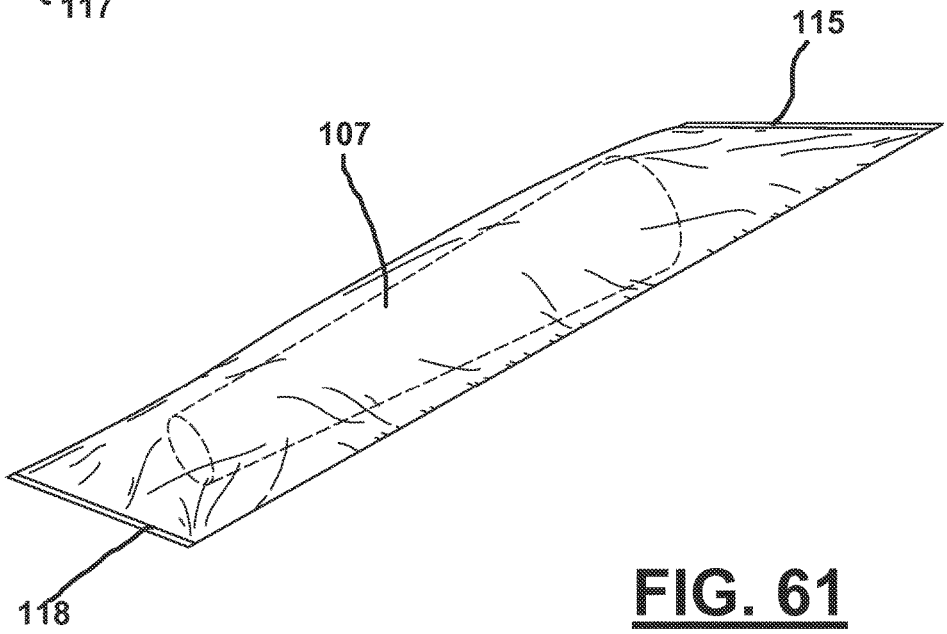
FIG. 61 is a perspective view of the sixth r embodiment of the apparatus of the present invention.

In FIGS. 60-61, a flexible plastic package or wrapper 114 is shown. The package or wrapper 114 has closed end 115 and open end 116 that would enable insertion of the combination of shell 107 and form 110 into interior 117. A seal could be formed at 118 in order to encapsulate the combination of shell 107 and form 110 within interior 117 of package 114.

Figure 62:
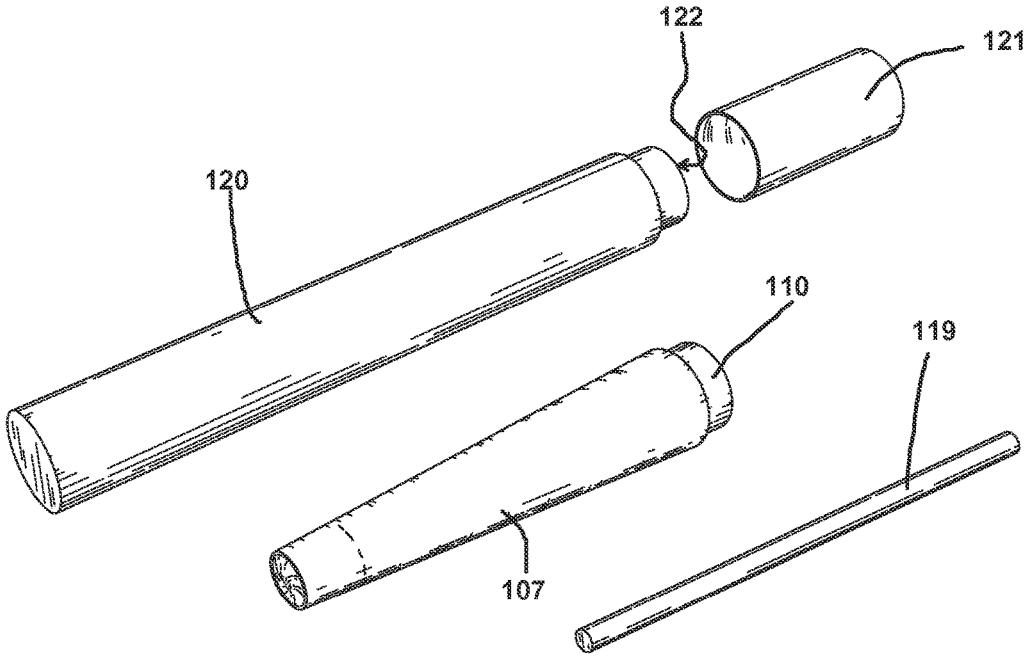
FIG. 62 is a perspective view of the sixth embodiment of the apparatus of the present invention.
Figure 63:
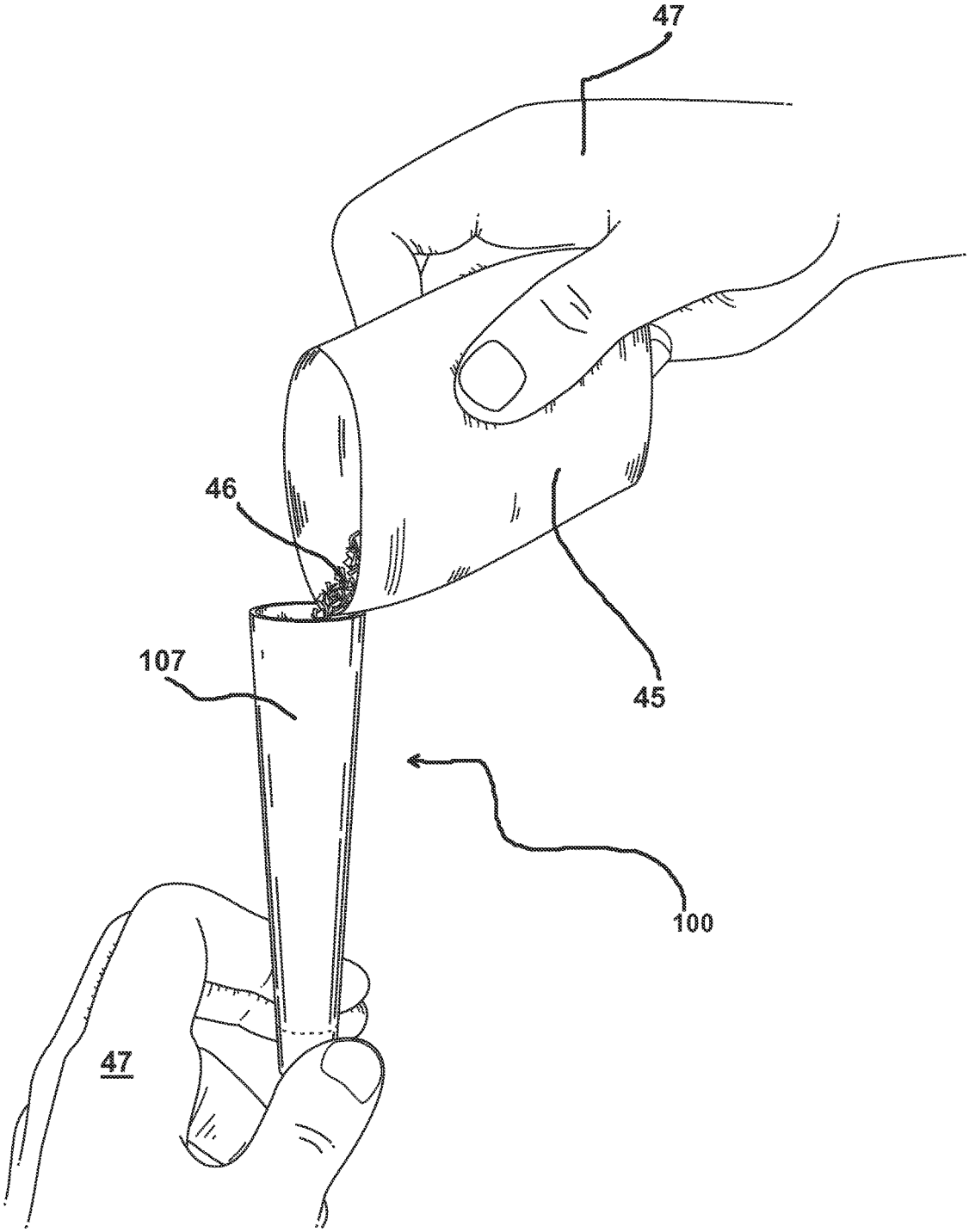
FIG. 63 is a perspective view of the sixth embodiment of the apparatus of the present invention.
Figures 64, 65:
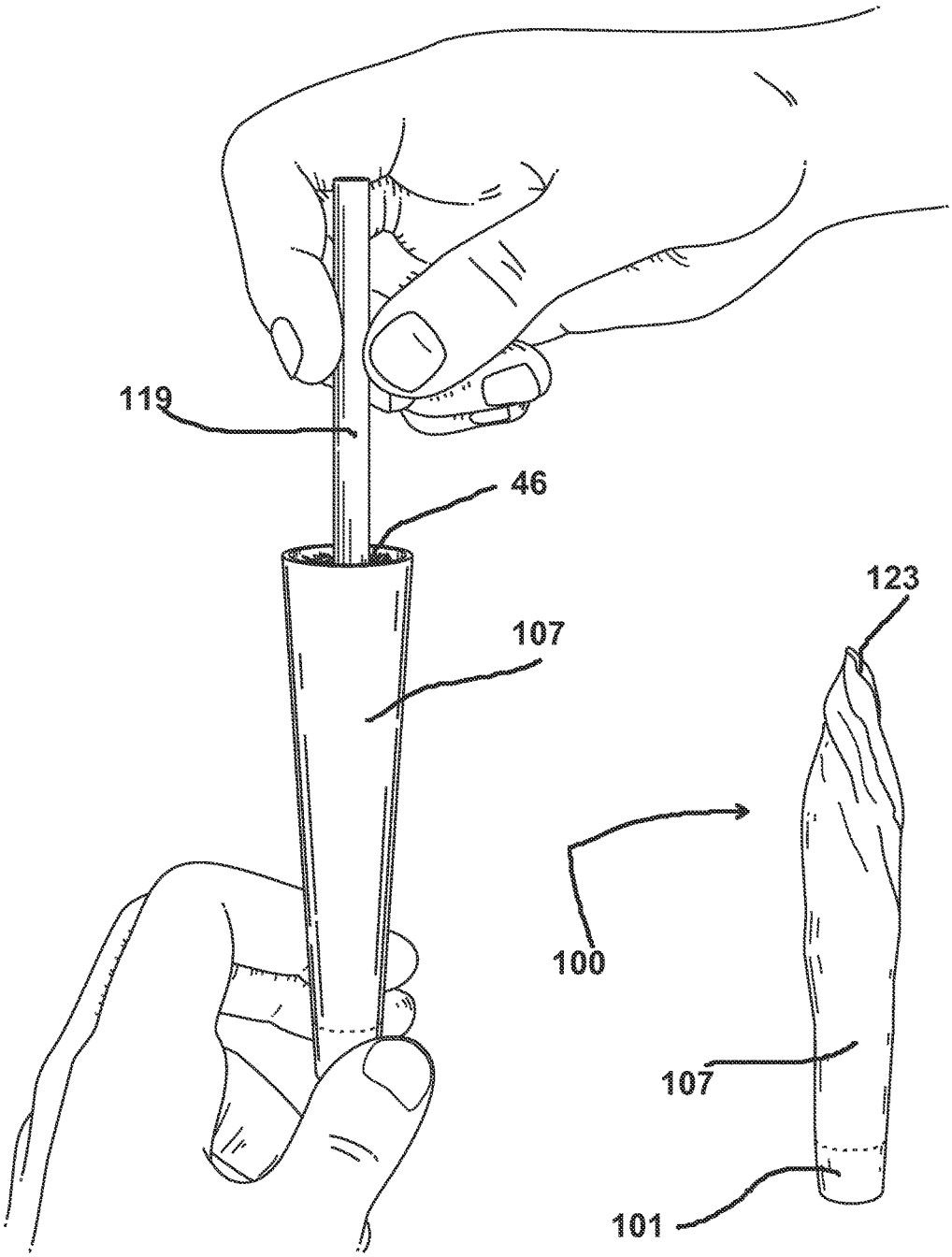
FIG. 64 is a perspective view of the sixth embodiment of the apparatus of the present invention.
FIG. 65 is a perspective view of the sixth embodiment of the apparatus of the present invention.

In FIG. 62, a cylindrically shaped package 120 is shown having interior 122. The form 110 would be hollow to accept and contain rod 119. The combination of shell 107, form 110 and rod 119 would be stored within interior 122 of tubular package 120. A closure cap 121 would enable closure of tubular package 120 after it contains shell 107, form 110 and rod 119. FIGS. 63-65 illustrate assembly of shell 107 into a finished smokable article 100. In FIG. 63, a user 47 inserts his or her custom tobacco filler 46 into shell 107. The user 47 could dispense custom tobacco filler material from pouch 45 as shown in FIG. 63.

Figure 66:
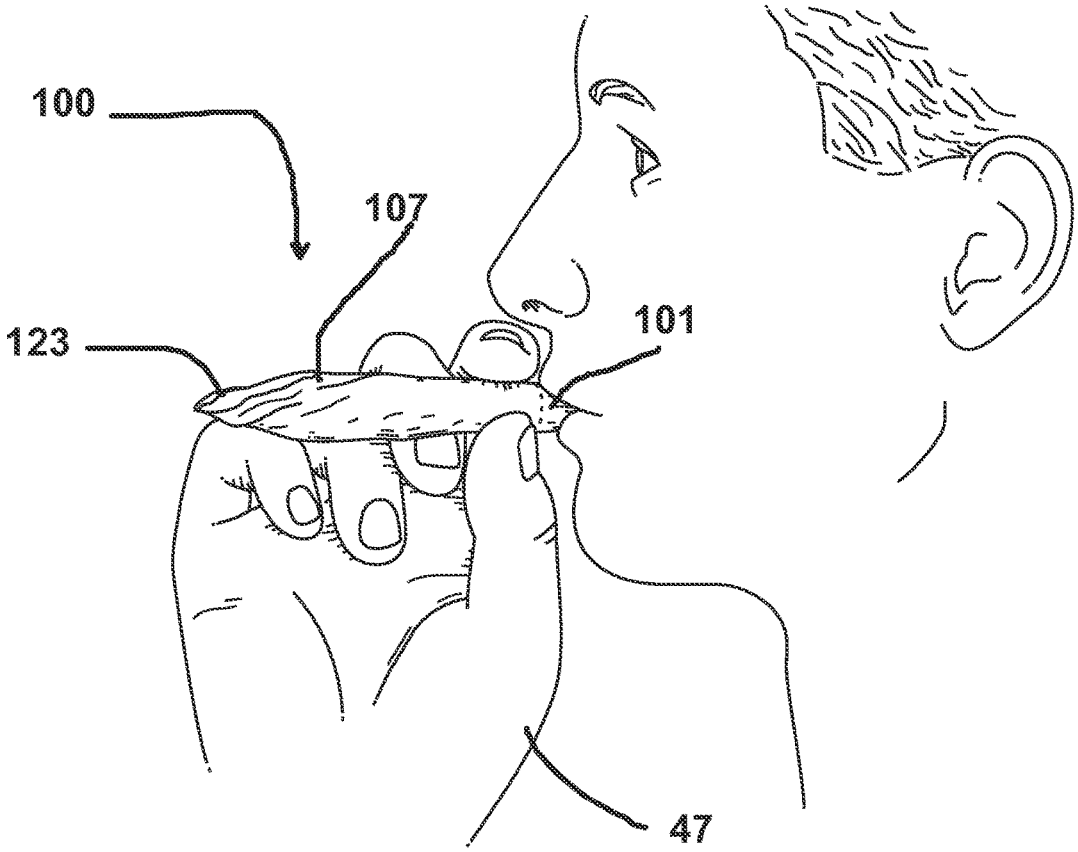
FIG. 66 is a perspective view of the sixth embodiment of the apparatus of the present invention.
Figure 67:
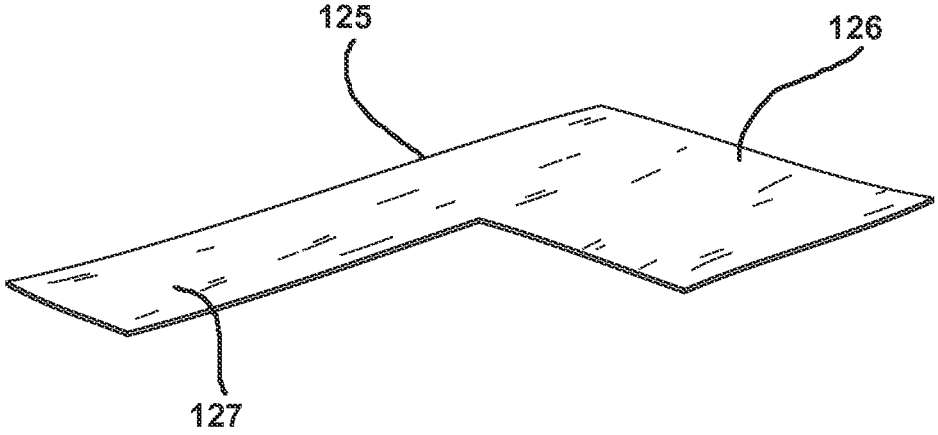
FIG. 67 is a partial perspective view of a seventh another embodiment of the apparatus of the present invention.

In FIGS. 64 and 65, rod 119 is used to compress the custom tobacco filler material once added to cone or shell 107. A user then closes the shell 107 at twisted portion or closed end 123 which is opposite filter element 101. The user 47 then lights the closed end or twisted end 123 in order to smoke the article 100, as shown in FIG. 66. The entire article 100 could be smoked including the filter element 101.

Figure 68:
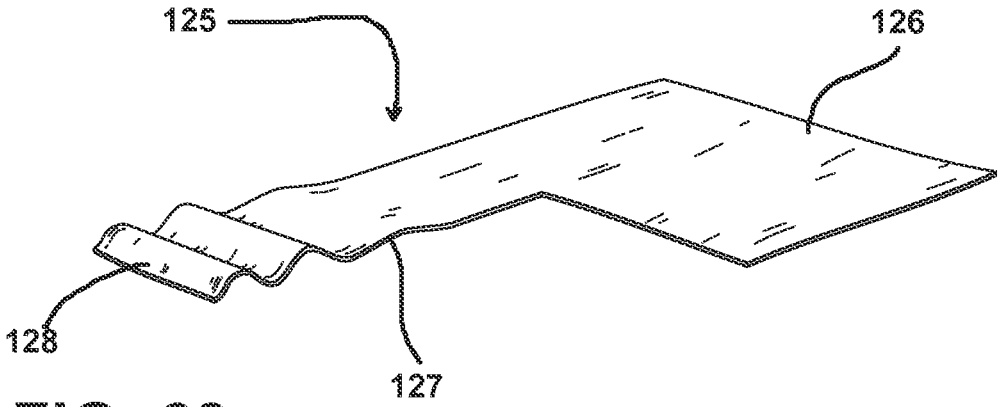
FIG. 68 is a partial perspective view of the seventh embodiment of the apparatus of the present invention and illustrating the method of the present invention.
Figure 69:
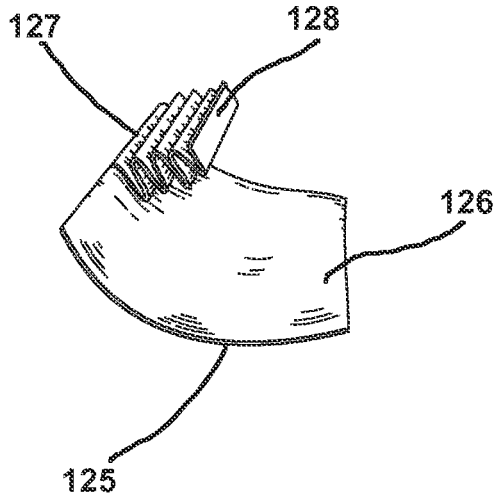
FIG. 69 is a partial perspective view of the seventh embodiment of the apparatus of the present invention and illustrating the method of the present invention.
Figure 70:
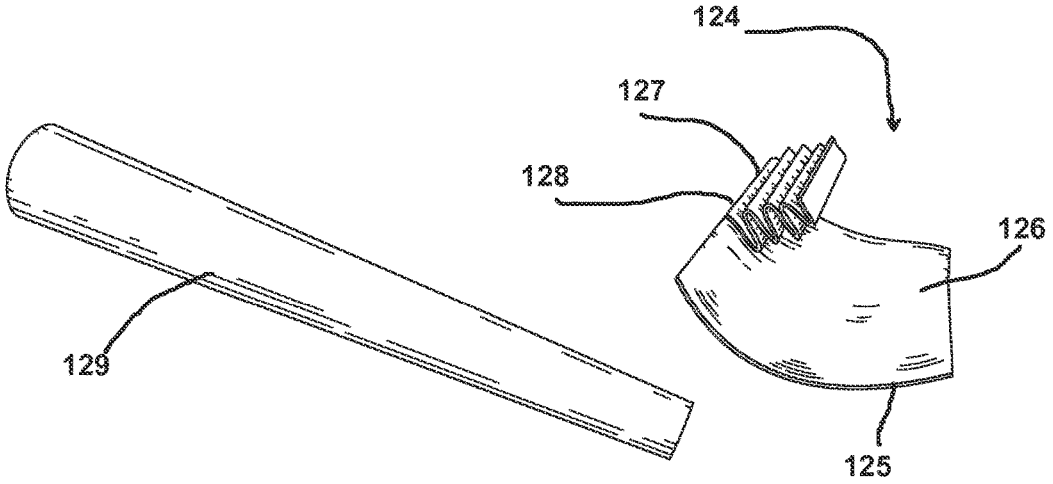
FIG. 70 is a partial perspective view of the seventh embodiment of the apparatus of the present invention and illustrating the method of the present invention.
Figure 71:
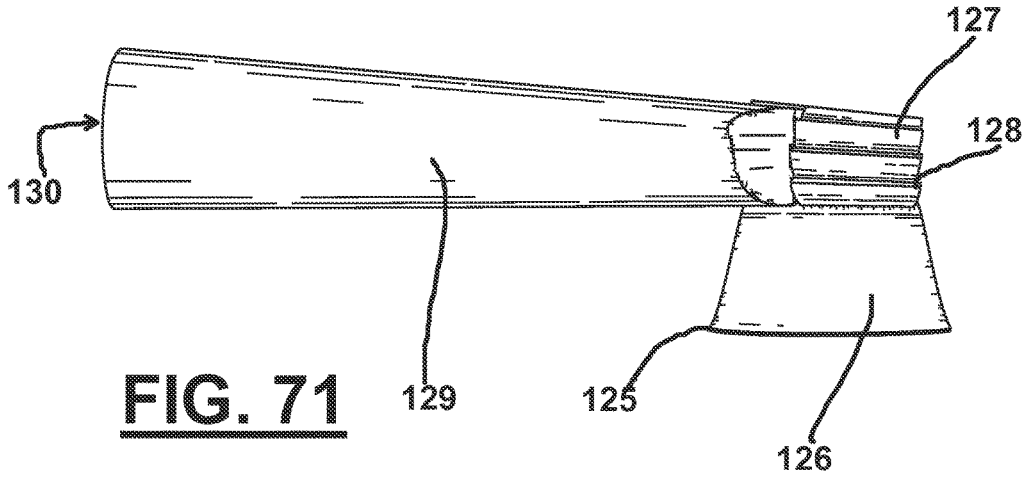
FIG. 71 is a partial perspective view of the seventh embodiment of the apparatus of the present invention and illustrating the method of the present invention.
Figure 72:
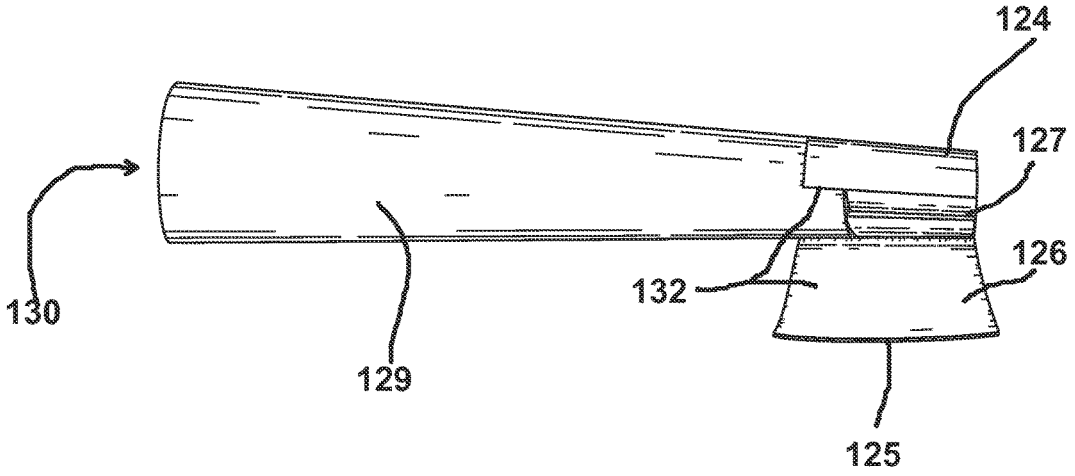
FIG. 72 is a partial perspective view of the seventh embodiment of the apparatus of the present invention and illustrating the method of the present invention.
Figure 73:
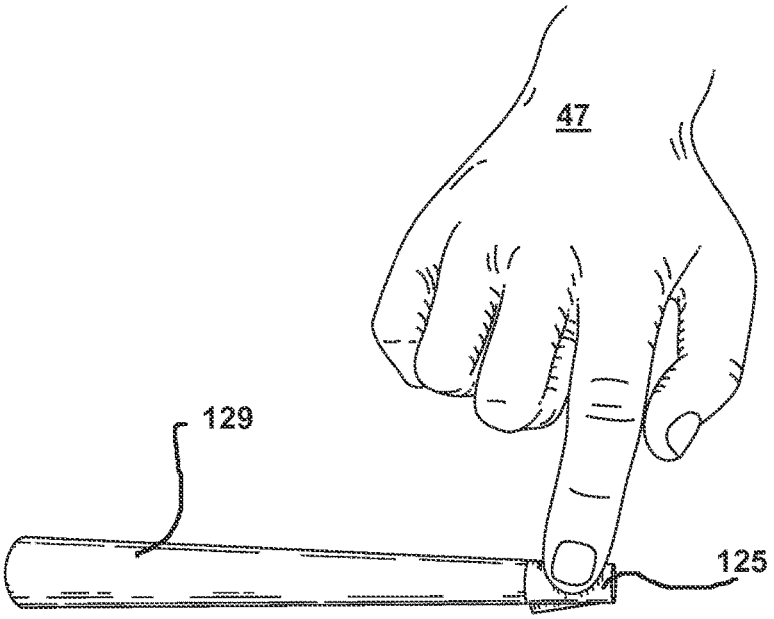
FIG. 73 is a partial perspective view of the seventh embodiment of the apparatus of the present invention and illustrating the method of the present invention.

FIGS. 67-75 shows a seventh embodiment including a filter part 124 that can be formed from sheet 125. Sheet 125 has first section 126 which can be rectangular and joined to second section 127 which can be rectangular. The second section 127 can be folded or formed into corrugations 128 as shown in FIGS. 68 and 69. The corrugations 128 can include peaks and valleys or ridges and troughs as shown in FIGS. 68 and 69 and as described in relation to corrugations or folds of earlier embodiments (e.g. see FIGS. 3-4).

Figure 74:
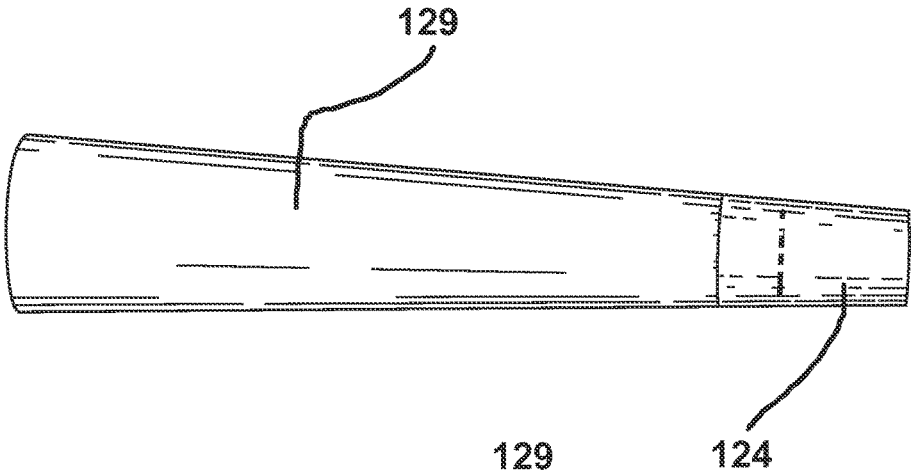
FIG. 74 is a partial perspective view of the seventh embodiment of the apparatus of the present invention and illustrating the method of the present invention.
Figure 75:
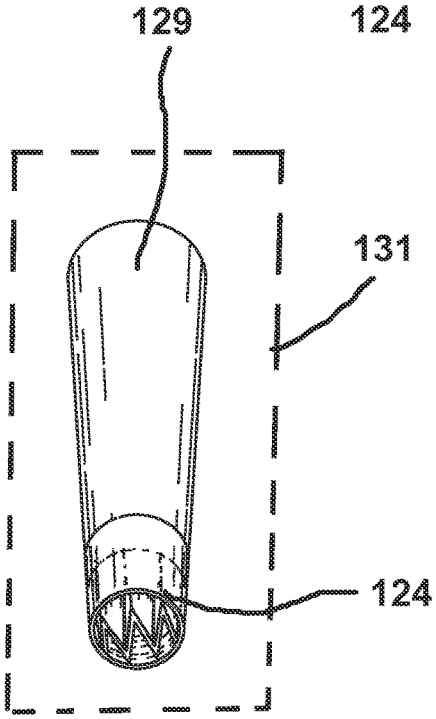
FIG. 75 is a partial perspective view of the seventh embodiment of the apparatus of the present invention and illustrating the method of the present invention.

In FIGS. 70-75, the filter part 124 can be attached (for example, using glue or adhesive) to cone or shell 129. The cone or shell 129 has a bore or interior 130. In FIGS. 74 and 75, the cone or shell 129 is joined to the filter element 124 as shown using an adhesive at 132. In FIGS. 62 and 63, the combination of cone or shell 129 and filter element 124 can be packaged in a wrapper or other package 131.

Figure 76:
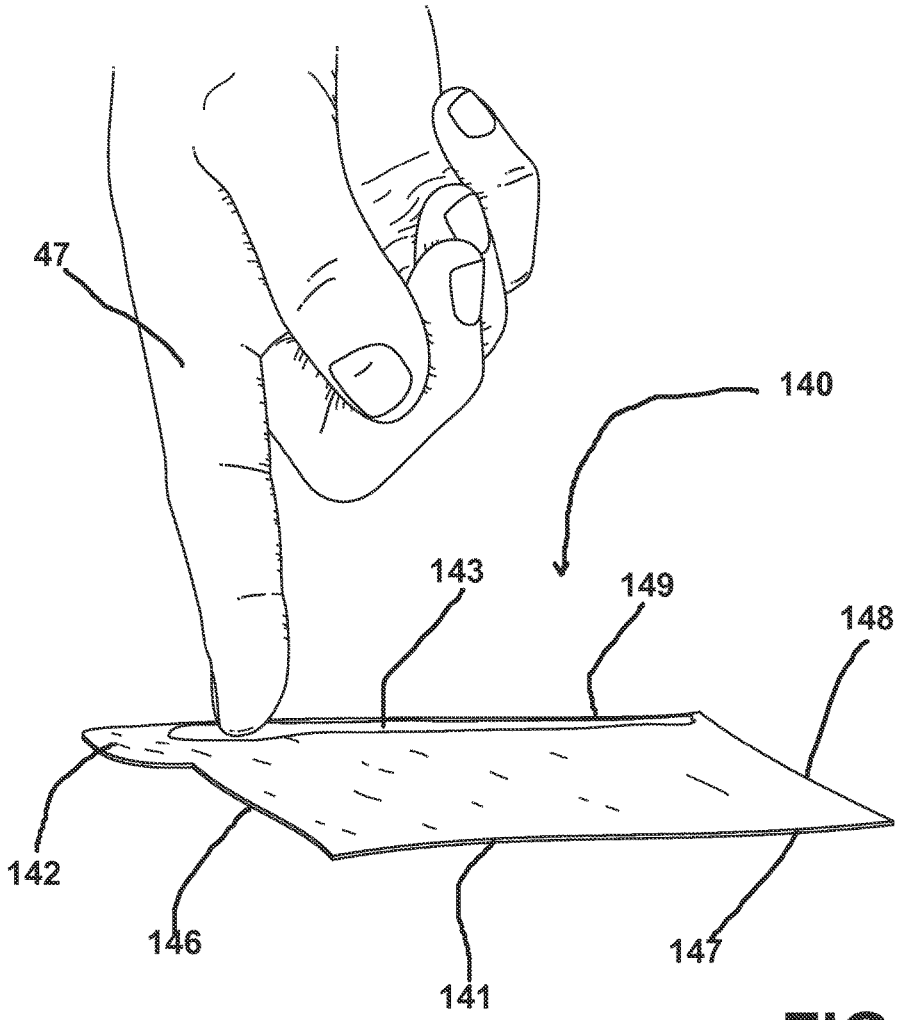
FIG. 76 is a partial perspective view of an eighth embodiment of the apparatus of the present invention and illustrating the method of the present invention.
Figure 77:
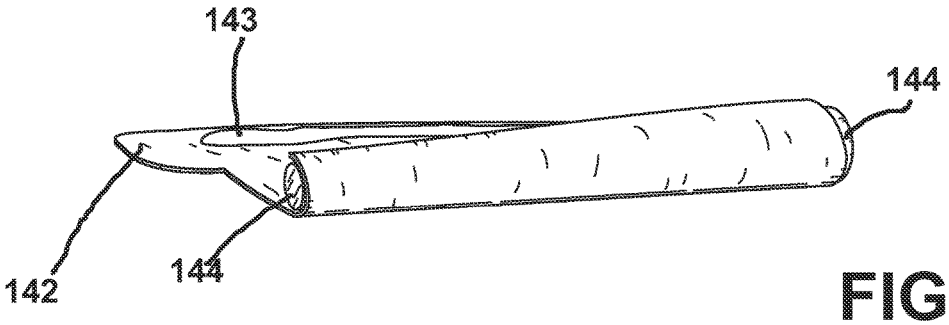
FIG. 77 is a partial perspective view of the eighth embodiment of the apparatus of the present invention and illustrating the method of the present invention.
Figure 78:
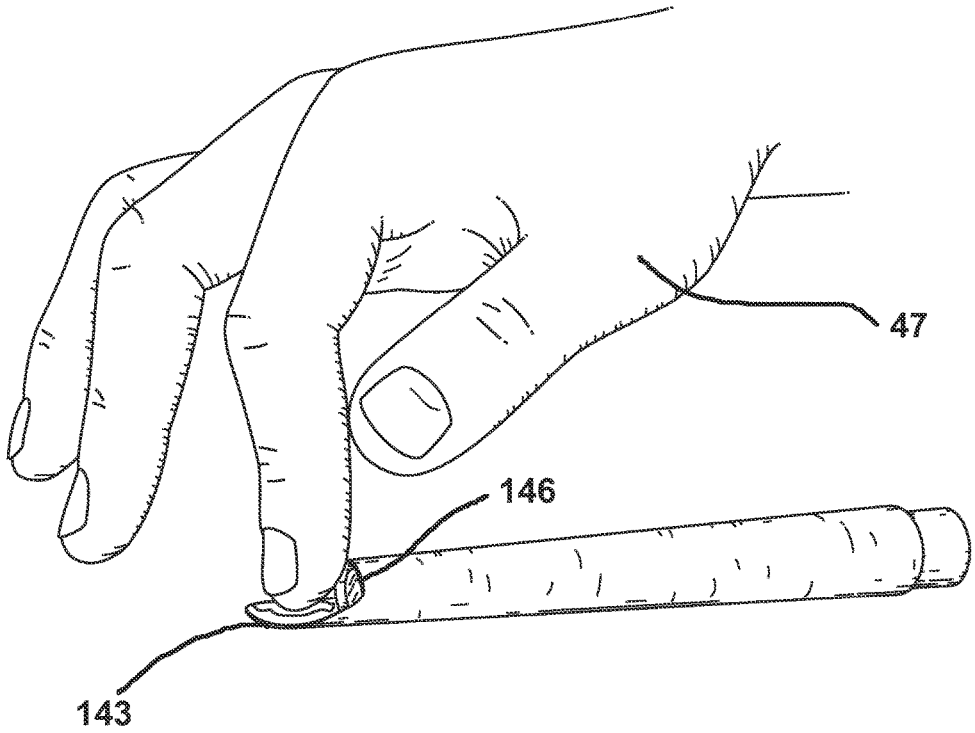
FIG. 78 is a partial perspective view of the eighth embodiment of the apparatus of the present invention and illustrating the method of the present invention.
Figure 79:
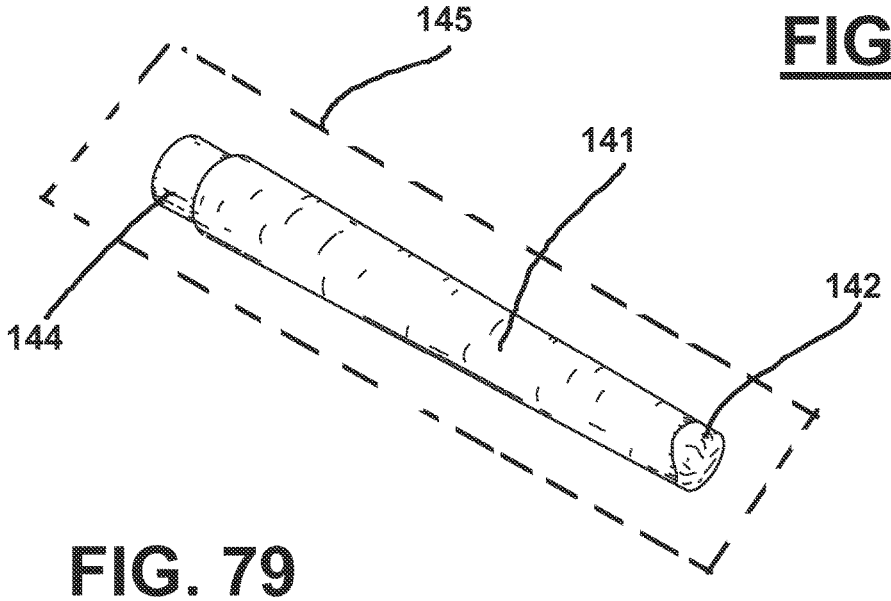
FIG. 79 is a partial perspective view of the eighth embodiment of the apparatus of the present invention and illustrating the method of the present invention.

FIGS. 76-82 shows an eighth embodiment of the apparatus of the present invention designated generally by the numeral 140. Smokable article 140 includes a sheet of material 141 having a protrusion or tab 142. Other than the tab 142, the remaining portion of the sheet 141 can be rectangular, bordered by edges 146, 147, 148, 149. A strip of adhesive or glue 143 can be provided on sheet 141, extending to tab or protrusion 142 as shown in FIGS. 76 and 77. A frustoconically shaped form 144 can be used to shape the sheet of material 141 into a cone as shown in FIGS. 77 and 78. A user 47 then glues the tab or protrusion 142 to the sheet 141 using adhesive or glue 143 as shown in FIG. 78 to provide a closed end at edge 146. The conically shaped form 141 and its closed end at 142 could then be packaged in a wrapper or package 145 as shown in FIG. 79.

Figure 80:
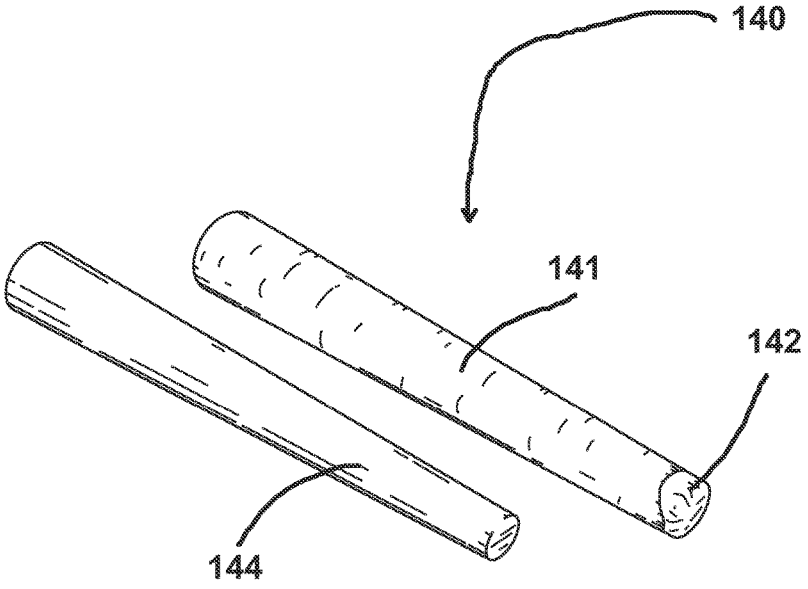
FIG. 80 is a partial perspective view of the eighth embodiment of the apparatus of the present invention and illustrating the method of the present invention.
Figure 81:
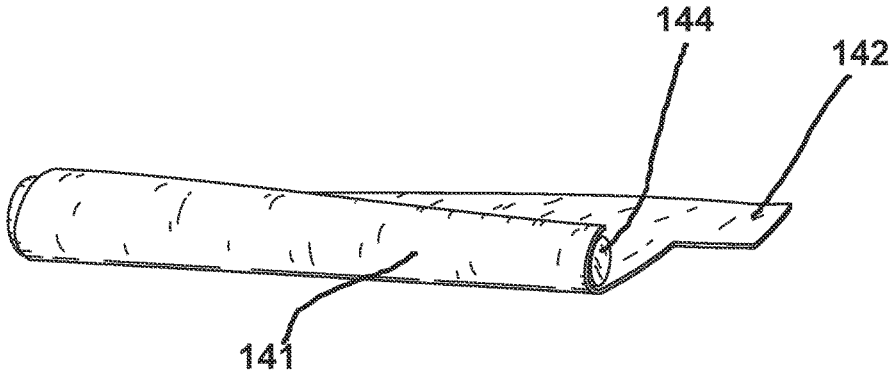
FIG. 81 is a partial perspective view of the eighth embodiment of the apparatus of the present invention and illustrating the method of the present invention.
Figure 82:
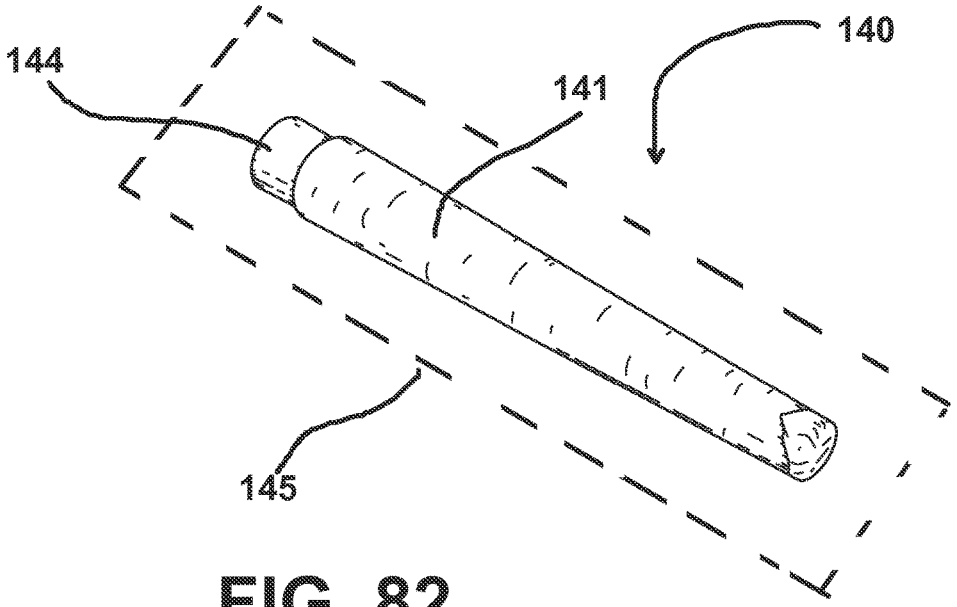
FIG. 82 is a partial perspective view of the eighth embodiment of the apparatus of the present invention and illustrating the method of the present invention.
Figure 84:
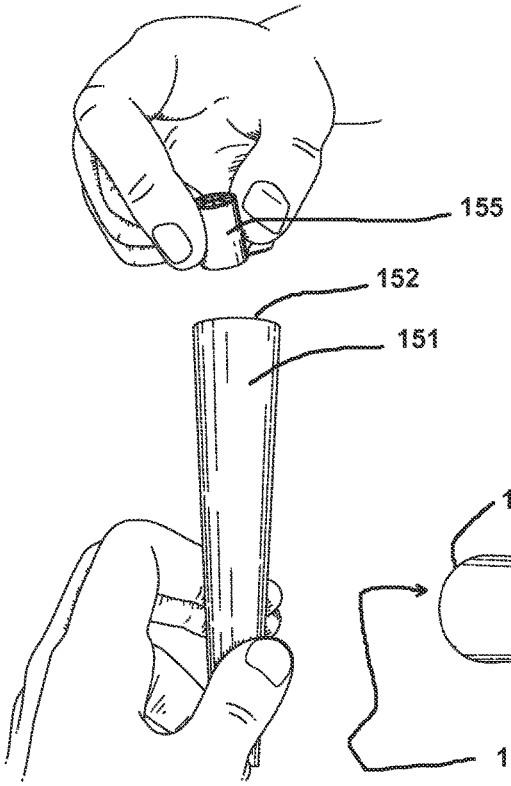
FIG. 84 is a perspective view of the ninth embodiment of the apparatus of the present invention and illustrating the method of the present invention.
Figure 83:
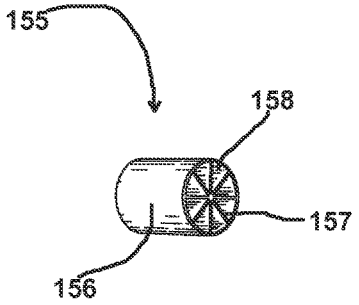
FIG. 83 is a partial perspective view of a ninth embodiment of the apparatus of the present invention.

A frustoconically shaped form 144 could be placed in the conically shaped sheet 141 as shown in FIG. 80. In FIG. 82, the combination of form 144 and sheet 141 could be packaged in a wrapper or package 145.

Figure 85:
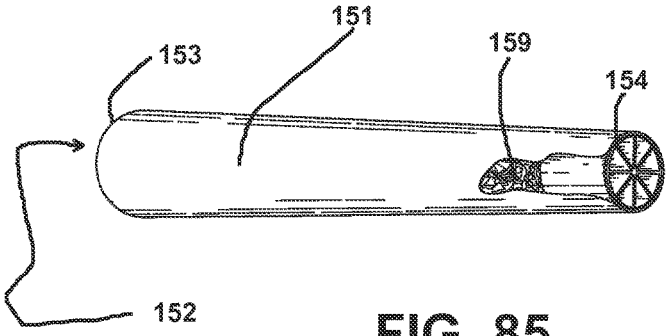
FIG. 85 is a perspective view of the ninth embodiment of the apparatus of the present invention and illustrating the method of the present invention.
Figure 86:
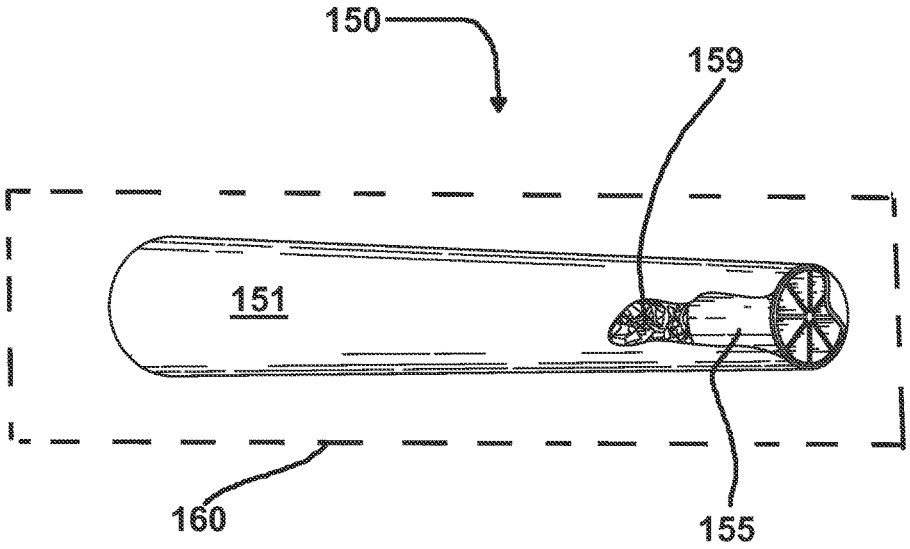
FIG. 86 is a perspective view of the ninth embodiment of the apparatus of the present invention and illustrating the method of the present invention.

FIGS. 83-87 show a ninth embodiment of the present invention. In FIGS. 83-87, smokable article 150 includes a filter element 145 that can be joined to a cone shaped shell or shell 151. The shell 151 has a hollow interior 152 that can receive the filter element 155 as well as a user's custom tobacco filler material. The shell 151 has larger diameter end 153 and smaller diameter end 154. The filter element 155 can have a cylindrically shaped or frustoconically shaped outer wall 156, and a hollow interior that is filled with a plurality of radially extending plates 157. The plates 157 converge and meet at central joint portion 158. A user can add his or her tobacco filler material to the cone 151 as shown in FIG. 85. The article 151 can be packaged in a package 160 as shown in FIG. 86.

Figure 87:
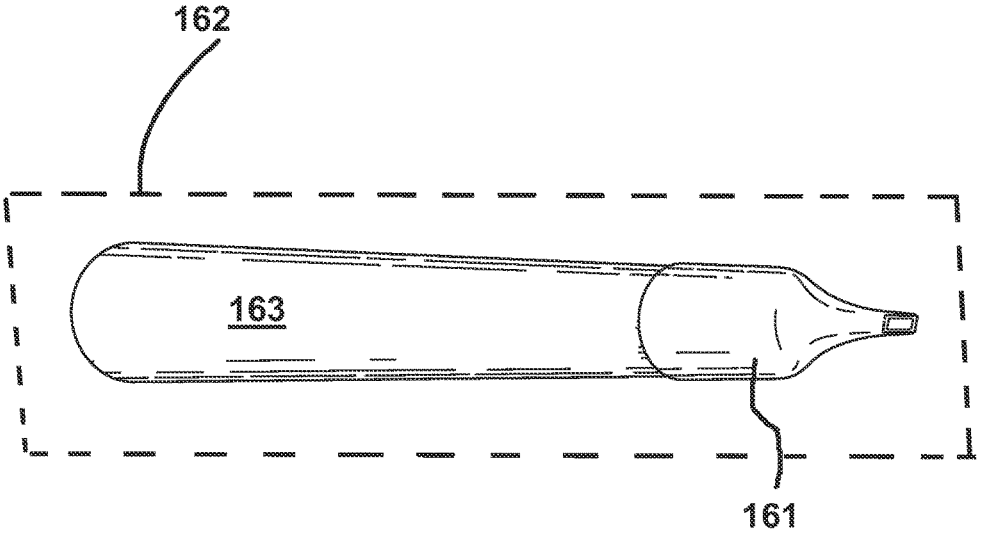
FIG. 87 is a perspective view of the ninth embodiment of the apparatus of the present invention and illustrating the method of the present invention.

FIG. 87 illustrates that any shell 163 of any of the embodiments of FIGS. 1-87 can be packaged in a package or wrapper 162 and fitted with a mouthpiece 161.

The following is a list of parts and materials suitable for use in the present invention:

PARTS LIST:

| PART NUMBER | DESCRIPTION |
|---|---|
| 10 | smoking article |
| 11 | sheet of material |
| 12 | cut/slot/score |
| 13 | cut/slot/score |
| 14 | larger section |
| 15 | side edge |
| 16 | side edge |
| 17 | end edge |
| 18 | smaller section |
| 19 | side edge |
| 20 | side edge |
| 21 | end edge |
| 22 | hinge/bridge section/tab |
| 23 | corrugation/folds |
| 24 | trough/groove |
| 25 | peak/ridge |
| 26 | edge |
| 27 | edge |
| 28 | dimension |
| 29 | dimension |
| 30 | arrow |
| 31 | frustoconical form/mandrel |
| 32 | bore/open ended bore |
| 33 | package/wrapper |
| 34 | closed end |
| 35 | open end |
| 36 | interior |
| 37 | seal |
| 38 | tubular package |
| 39 | closed end |
| 40 | open end |
| 41 | closure cap |
| 42 | rod |
| 43 | hollow interior |
| 44 | opening/open end |
| 45 | pouch/container |
| 46 | smokable material |
| 47 | smoker |
| 48 | closure |
| 49 | filter end |
| 50 | filter |
| 51 | smaller diameter end |
| 52 | larger diameter end |
| 53 | smaller diameter opening |
| 54 | larger diameter opening |
| 55 | circular rim |
| 60 | smoking article |
| 61 | sheet of material |
| 62 | cut/score/slot |
| 63 | cut/score/slot |
| 64 | hinge/bridge/section/tab |
| 65 | smaller section |
| 66 | larger section |
| 70 | smokable article |
| 71 | sheet |
| 72 | cut/slot/score |
| 73 | hinge/bridge/section/tab |
| 74 | larger section |
| 75 | smaller section |
| 76 | smokable article |
| 77 | sheet of material |

-continued

PARTS LIST:

| PART NUMBER | DESCRIPTION |
|---|---|
| 78 | cut/slot/score |
| 79 | larger section |
| 80 | smaller section |
| 81 | hinge/bridge/section/tab |
| 82 | side edge |
| 83 | side edge |
| 84 | end edge |
| 85 | end edge |
| 86 | sheet of material |
| 87 | cut/score/slot |
| 88 | smaller section |
| 89 | larger section |
| 90 | hinge/bridge/section/tab |
| 91 | edge |
| 92 | edge |
| 93 | edge |
| 94 | edge |
| 95 | edge |
| 96 | edge |
| 97 | edge |
| 100 | smokable article |
| 101 | filter element |
| 102 | outer frusto-conical sleeve |
| 103 | interior |
| 104 | tobacco filler |
| 105 | annular rim |
| 106 | closed end |
| 107 | tobacco shell/smokable material cone |
| 108 | hollow bore |
| 109 | larger diameter opening |
| 110 | frustoconical form |
| 111 | frustoconical tube |
| 112 | cap/closure |
| 113 | interior |
| 114 | package/wrapper |
| 115 | closed end |
| 116 | open end |
| 117 | interior |
| 118 | seal |
| 119 | rod |
| 120 | tubular package |
| 121 | cap/closure |
| 122 | hollow interior |
| 123 | closed end/twisted end |
| 124 | filter part |
| 125 | sheet |
| 126 | first section |
| 127 | second section |
| 128 | corrugation/fold |
| 129 | cone/shell |
| 130 | bore/interior |
| 131 | package |
| 132 | adhesive |
| 140 | smokable article |
| 141 | sheet of material |
| 142 | tab/protrusion |
| 143 | glue/adhesive strip |
| 144 | form |
| 145 | package |
| 146 | edge |
| 147 | edge |
| 148 | edge |
| 149 | edge |
| 150 | smokable article |
| 151 | cone shaped shell/shell |
| 152 | hollow interior |
| 153 | larger diameter end |
| 154 | smaller diameter end |
| 155 | filter element |
| 156 | wall |
| 157 | radially extending plate |
| 158 | central joint portion |
| 159 | tobacco filler |
| 160 | package |
| 161 | mouthpiece |

-continued

| PARTS LIST: | |
|---|---|
| PART NUMBER | DESCRIPTION |
| 162 | package |
| 163 | shell |
| 200 | center |
| 210 | curvature |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A smoking article, comprising:

a) a sheet of smokable material having a plurality of edges;

b) one or more score or cuts in the sheet that each extend a partial distance from a first said edge toward a second said edge, the score or cut separating large and small sections of the sheet;

c) a hinge defined by a portion of the sheet of smokable material that is next to a score or cut, said hinge joining the large section to the small section;

d) a conically shaped form that has an outer surface, a large diameter end, a small diameter end, and a cavity that extends to said small diameter end;

e) corrugations on the small section of the sheet that enable the small section to be fitted into the cavity via the small diameter end;

f) the hinge enabling the sheet to fold when the small section occupies the cavity in an assembled position, wherein in said assembled position the large section is wrapped around the form outer surface to make a cone having a larger diameter end and a smaller diameter end; and g) wherein the assembled position, the corrugations enable the small section to gather together to define a filter positioned at the smaller diameter end of the cone.

2. The smoking article of claim 1 wherein there are two scores or cuts and said hinge is in between the two scores or cuts.

3. The smoking article of claim 1 wherein there is one score or cut and said hinge is in between the score or cut and a said edge.

4. The smoking article of claim 1 wherein the sheet is held in a conical shape with a fastener in said assembled position.

5. The smoking article of claim 4 wherein the fastener includes an adhesive.

6. The smoking article of claim 1 wherein the form cavity is an open ended bore.

7. The smoking article of claim 2 wherein the hinge is spaced equally between two of said edges.

8. The smoking article of claim 2, wherein the hinge is spaced closer to the first edge than the second edge.

9. The smoking article of claim 1 wherein the first and second edges define an acute angle.

10. The smoking article of claim 1 wherein an edge at said small diameter section has first and second positions that define an obtuse angle.

11. A method of constructing a smokable article, comprising the steps of:

a) providing a form having a frustoconical shape, a first smaller diameter end having an opening, a larger diameter end, and a cavity that extends to said smaller diameter opening;

b) providing a sheet of smokable material having a plurality of edges;

c) forming a cut or score on the sheet of material that extends only a partial distance from one edge toward a second edge;

d) locating a hinge positioned in between said cut or score and said second edge;

e) the score or cut and hinge being in between a large section and a small section of said sheet after step "d";

f) collapsing the small section to form a filter;

g) fitting the collapsed small section into the cavity via the small diameter opening;

h) wrapping the large section about the form outer surface to construct a cone that has a larger diameter opening and a smaller diameter opening;

i) wherein in step "h" the hinge bends at the form smaller diameter end of the form; and j) packaging the cone and filter.

12. The method of claim 11, wherein the form and sheet of material are nested, wherein the sheet large section is wrapped around the form.

13. The method of claim 11, wherein in step "h" a connecting material holds the sheet in a wrapped, generally frustoconically shaped position.

14. The method of claim 11, further comprising the step of separating the form and the sheet after step "i".

* * * * *